US008998274B2

(12) United States Patent
Fehr et al.

(10) Patent No.: US 8,998,274 B2
(45) Date of Patent: Apr. 7, 2015

(54) SELF-LATCHING AND SELF-LOCKING LATCH SYSTEM FOR SLIDING DOOR PANELS

(75) Inventors: David A. Fehr, Morton, IL (US); Wayne A. Knepp, Morton, IL (US); Brian Cook, Peoria, IL (US)

(73) Assignee: Morton Buildings, Inc., Morton, IL (US)

( * ) Notice: Subject to any disclaimer, the term of this patent is extended or adjusted under 35 U.S.C. 154(b) by 153 days.

(21) Appl. No.: 13/211,209

(22) Filed: Aug. 16, 2011

(65) Prior Publication Data

US 2012/0043767 A1 Feb. 23, 2012

Related U.S. Application Data

(60) Provisional application No. 61/374,545, filed on Aug. 17, 2010.

(51) Int. Cl.

| | |
|---|---|
| ***E05C 3/04*** | (2006.01) |
| ***E05B 65/08*** | (2006.01) |
| ***E05C 17/60*** | (2006.01) |
| ***E05C 19/04*** | (2006.01) |
| *E05C 19/00* | (2006.01) |
| *E05C 9/00* | (2006.01) |
| *E05C 19/10* | (2006.01) |
| *E05C 19/12* | (2006.01) |
| *E05C 5/00* | (2006.01) |
| *E05B 53/00* | (2006.01) |
| *E05C 17/48* | (2006.01) |

(52) U.S. Cl.

CPC ..... *E05B 65/0817* (2013.01); *E05B 65/0882* (2013.01); *E05C 17/60* (2013.01); *E05C 19/04* (2013.01); *E05B 53/003* (2013.01); *E05C 17/48* (2013.01)

(58) Field of Classification Search

USPC ..... 292/1–8, 11, 24–29, 44–50, 57, 58, 292/63–66, 95, 109–111, 113, 121–126, 97, 292/98, 240, 194, 219, 220, 222–226, 292/195–197, DIG. 12, DIG. 21, DIG. 36, 292/DIG. 46, DIG. 64

See application file for complete search history.

(56) References Cited

U.S. PATENT DOCUMENTS

| | | | | |
|---|---|---|---|---|
| 1,209,733 A | | 12/1916 | Lester | |
| 1,250,816 A | | 12/1917 | Dunderdale | |
| 1,573,866 A | * | 2/1926 | Rogers | 292/113 |
| 1,596,242 A | | 8/1926 | Dunn | |
| 1,597,682 A | | 8/1926 | Hagstrom | |

(Continued)

FOREIGN PATENT DOCUMENTS

| | | |
|---|---|---|
| CN | 2268092 Y | 11/1997 |
| CN | 2639468 Y | 9/2004 |

*Primary Examiner* — Carlos Lugo
*Assistant Examiner* — Faria Ahmad
(74) *Attorney, Agent, or Firm* — Howard & Howard Attorneys PLLC

(57) ABSTRACT

A sliding door latching and locking system is disclosed which includes a latch assembly, a lift rod assembly, and a retainer assembly, among other things. In some embodiments, the latch assembly includes a support member mounted in a movable body and a latching arm pivotally mounted to the support member having a distal end thereof extending outside of the periphery of the movable body, wherein the distal end includes an engagement facilitating portion with a sloped outer surface for contacting an interlocking member.

18 Claims, 17 Drawing Sheets

(56) References Cited

U.S. PATENT DOCUMENTS

| | | | | | |
|---|---|---|---|---|---|
| 2,437,403 | A | | 3/1948 | Rice | |
| 2,575,465 | A | | 11/1951 | Patton | |
| 2,646,719 | A | * | 7/1953 | Spriggs | 24/3.12 |
| 2,659,230 | A | | 11/1953 | Craig | |
| 2,687,031 | A | | 8/1954 | Craig | |
| 2,862,378 | A | | 12/1958 | Harris | |
| 3,024,054 | A | * | 3/1962 | Eads | 292/126 |
| 3,025,693 | A | | 3/1962 | Braginetz | |
| 3,039,153 | A | | 6/1962 | Dusing | |
| 3,045,464 | A | * | 7/1962 | Braginetz | 70/144 |
| 3,094,861 | A | | 6/1963 | Sayles | |
| 3,150,894 | A | * | 9/1964 | Sant | 292/201 |
| 3,207,544 | A | * | 9/1965 | Miller | 292/109 |
| 3,265,118 | A | | 8/1966 | Smith | |
| 3,391,553 | A | * | 7/1968 | Norrenberg-Sudhaus | 70/70 |
| 3,514,142 | A | * | 5/1970 | Smith | 292/113 |
| 3,534,431 | A | | 10/1970 | Uphoff | |
| 3,936,086 | A | * | 2/1976 | Berkowitz | 292/341.17 |
| 3,938,836 | A | | 2/1976 | Smith | |
| 4,081,880 | A | | 4/1978 | Edeus | |
| 4,513,535 | A | | 4/1985 | Uphoff | |
| 5,388,875 | A | | 2/1995 | Fleming | |
| 5,595,409 | A | | 1/1997 | Fier et al. | |
| 6,196,034 | B1 | | 3/2001 | Diebold et al. | |
| 6,330,763 | B1 | | 12/2001 | Kern et al. | |
| 6,582,036 | B2 | * | 6/2003 | Alexander et al. | 312/326 |
| 7,155,861 | B2 | | 1/2007 | Berry et al. | |
| 7,757,437 | B2 | | 7/2010 | Schulte et al. | |
| 7,942,027 | B1 | | 5/2011 | Cassini | |
| 2004/0066046 | A1 | * | 4/2004 | Becken | 292/39 |

* cited by examiner

SELF-LATCHING AND SELF-LOCKING LATCH SYSTEM FOR SLIDING DOOR PANELS

CROSS-REFERENCE TO RELATED APPLICATION(S)

This application claims priority to U.S. Provisional Application No. 61/374,545 filed Aug. 17, 2010, the disclosure of which is incorporated herein.

BACKGROUND OF THE INVENTION

Horizontal sliding doors, which actually may slide or roll, usually include one or more door panels suspended by carriages that travel along an overhead track. The carriages allow the door panels to slide or roll in a generally horizontal direction in front of a doorway to open and close the door. The door may be manually or automatically moved from its open and closed position. Sliding doors such as these are often used with storage structures such as barns.

Depending on the width of the doorway and the space along either side of it, a sliding door can assume a variety of configurations. For a relatively narrow doorway with adequate space alongside to receive an opening door panel, a single door panel is typically enough to cover the doorway. Wider doorways with limited side space may require a bi-parting sliding door that includes at least two panels each moving in the same plane in opposite directions from either side of the doorway and meeting at the center of the doorway to close the door. For even wider doorways or those with even less side space, multi-panel sliding doors can be used. Multi-panel doors have at least two parallel door panels that overlay each other at one side of the doorway when the door is open. To close the door, one panel slides out from behind the other as both panels move in front of the doorway to cover a span of about twice the width of a single panel. Applying such an arrangement to both sides of the doorway provides a bi-parting door with multiple panels on each side.

If any of these door arrangements are not properly secured, wind damage can occur. In fact, a sudden gust of wind may dislodge the doors from the track or tracks. Such wind damage may also cause deformation or damage to the frame or the door itself in cases where the door is inadequately supported. Thus, a more secure door configuration both in the open position, as well as the closed position is needed, among other things.

SUMMARY OF THE INVENTION

The invention is generally directed to locking and securing assemblies, which among other things, address the aforementioned needs, simplify the procedures for latching and locking and reduce the steps required to provide access without compromising security.

In some embodiments, the invention is directed to a latching and locking system for sliding doors, which generally includes various components, such as a latch assembly, a lifting rod assembly, a door catch and a retainer system.

In one embodiment, the latch assembly is designed to add the ability to lock and secure large sliding doors from the exterior as well as the interior of a building by combining multiple functions and actions through a single device. In another embodiment, the locking system includes a latch assembly, which includes a lockset on the exterior, a lifting rod assembly, a door catch, and a retainer system. The door can be unlocked using a key from the exterior of the door. The key immediately releases the handle restriction, and the handle operation unlatches the panels and disengages the lifting rod assembly, so that the operator can walk the panel to the opening jamb, where the door retainer automatically latches the panel in the open position. The lifting rod assembly is normally in the lower position so that it does not affect travel along the upper trolley track. When the handle is turned by the user, the lift bolt is raised up into the track and at that point it pushes the latch plate mechanism up and over the door stop that has latched the door in place. The door can be unlocked from the interior without a key. If the door is a double paneled door, the same operation is done for the second door.

For the door to close, the retainer must be released and the door slides and stops due to a stop at the end of the trolley travel, so that the panel remains in the closed position. The retainer catch serves to draw the door in tighter against the building and prevent the door from being pulled away in high winds. When in the closed position, the latch plate mechanism in the trolley stops on a door stop in the trolley track above the door header. In the single panel configuration, the latch assembly primary purpose is to prevent the door from opening. If the door has two panels, a similar door stop will stop each door, and the latch assemblies prevent each door from opening.

Some embodiments are directed to a latch assembly which includes: a support member mounted in a movable body, wherein the movable body is mounted on a structural frame for movement in an interior space defined by the structural frame into and between a substantially open position and a substantially closed position; a latching arm, including a proximal end pivotally mounted to the support member and configured to be biased toward a starting position, an intermediate section extending through an aperture in the movable body to a position adjacent to the periphery of the movable body, a distal end adjacent to the periphery of the movable body including an engagement facilitating portion extending in a substantially transverse direction with respect to the longitudinal axis of the intermediate section, the engagement facilitating portion having a sloped outer surface, wherein the engagement facilitating portion and intermediate section define a receiving space adjacent thereto; and an interlocking member extending in an opposing direction with respect to the engagement facilitating portion, wherein movement of the movable body into the closed position causes the interlocking member to contact the sloped outer surface of the engagement facilitating portion, the latching arm being responsive to the contact between the sloped outer surface of the engagement facilitating portion and the interlocking member by pivoting from the starting position and returning to the starting position upon the interlocking member being received by the receiving space.

In some embodiments, the movable body is a sliding door.

In some embodiments, the engagement facilitating portion has a triangular cross-sectional profile. In some embodiments, the engagement facilitating member includes an upper outer surface and a lower outer surface, wherein the upper and lower surfaces are sloped at substantially similar opposing slopes.

In some embodiments, the latching arm is operatively associated with at least one handle extending adjacent to the exterior of the movable body, wherein the latching arm pivots from the starting position in response to movement of the handle.

In some embodiments, the aforementioned latch assembly further includes a locking member configured for being set in an activated condition and a deactivated condition from the exterior of the movable body, wherein the locking member blocks pivotal movement of the latching arm upon being set in the activated condition and allows pivotal movement of the latching arm upon being set in the deactivated condition.

In some embodiments, the interlocking member further comprises a sloped outer surface at a substantially similar opposing slope with respect to the sloped outer surface of the engagement facilitating portion. In some embodiments, the interlocking member is part of a substantially similar opposing latching arm.

In some embodiments, the opposing latching arm is operatively associated with a support member mounted in a substantially similar opposing movable body mounted for movement in the interior space.

Some embodiments of the invention are also directed to a latch assembly which includes: a support member mounted in a sliding door body, wherein the sliding door body is mounted on a door frame for movement in an interior space defined by the door frame, into and between a substantially open position and a substantially closed position; a latching arm, including a proximal end pivotally mounted to the support member and configured to be biased toward a starting position, an intermediate section extending through an aperture in the movable body to a position adjacent to the periphery of the sliding door body, a distal end adjacent to the periphery of the movable body including an engagement facilitating portion extending in a substantially transverse direction with respect to the longitudinal axis of the intermediate section, the engagement facilitating portion having a sloped outer surface, wherein the engagement facilitating portion and intermediate section define a receiving space adjacent thereto; an interlocking member extending in an opposing direction with respect to the engagement facilitating portion, wherein movement of the sliding door body into the closed position causes the interlocking member to contact the sloped outer surface of the engagement facilitating portion, the latching arm being responsive to the contact between the sloped outer surface of the engagement facilitating portion and the interlocking member by pivoting from the starting position and returning to the starting position upon the interlocking member being received by the receiving space; and at least one handle extending adjacent to the exterior of the sliding door body operatively associated with the latching arm, wherein the latching arm pivots from the starting position in response to pivotal movement of the handle.

The latch assembly described above may further include a locking member configured for being set in an activated condition and a deactivated condition from the exterior of the movable body, wherein the locking member blocks pivotal movement of the latching arm upon being set in the activated condition and allows pivotal movement of the latching arm upon being set in the deactivated condition.

In some embodiments, the interlocking member may be part of a substantially similar opposing latching arm. The opposing latching arm may be operatively associated with a support member mounted in a substantially similar opposing sliding door mounted for movement in the interior space. The opposing latching arm is operatively associated with a support member mounted in the door frame. The interlocking member may be connected with the door frame.

Some embodiments of the invention are also directed to a latching retainer device attached to the jamb of a sliding door which extends outward from the jamb into the frame area in the central part of the door that engages a catch near the edge of the door that is beside the opening jamb when the door is closed. This latching device secures the panel at the jamb when the panel is fully closed.

In some embodiments, the aforementioned latching retainer device engages a ramp type bracket attached to the door panel and small rollers on the latching retainer device engage the ramp to slide the device away from the door and along the side of the jamb to allow the vertical frame members of the panel to pass by the retainer device.

In some embodiments, the latching retainer device is actuated by a spring device to keep pressure on the retainer so that it is forced outward at all times unless the force is overcome by the ramp attached to the door panel and drives the retainer backward to allow the vertical members of the panel to slide past the retainer.

In some embodiments, the latching retainer device includes an adjustment feature to position the end of the retainer in the correct location to engage the catch and the ramps.

In some embodiments, the latching retainer device is attached to the jamb of a sliding door which extends outward from the jamb into the frame area in the central part of the door and which drives outward after the vertical member at the edge of the panel has passed the edge of the jamb and latches the door in the open position, which among other things, facilitates a non-friction positive capture of the open panel such that the door cannot slip back partially into the opening and hence be vulnerable to wind damage.

In some embodiments, a latch mounted in a door track is capable of being actuated from the inside of the door by use of the internal latch handle that actuates a lift rod assembly by means of a cable.

These and other aspects of the invention and various embodiments thereof will become more readily apparent to those having ordinary skill in the art from the following detailed description of the invention and some embodiments thereof taken in conjunction with the drawings.

BRIEF DESCRIPTION OF THE DRAWINGS

So that those having ordinary skill in the art to which at least some embodiments of the invention pertains will more readily understand how to make and use systems, devices and methods in accordance therewith, such embodiments thereof will be described in enabling detail herein below with reference to the drawings. It should be noted that the drawings are not necessarily drawn to scale and certain figures may be shown in other form for illustrative reasons.

DETAILED DESCRIPTION

The following description contains illustrations of devices, systems and methods according to the invention for purposes of promoting an understanding of embodiments the invention, among other things. It should be understood that the scope of the invention is not limited by these embodiments. Alterations and modifications of the features of the invention, as well as additional applications of its principles in other forms or embodiments, such as those which would normally occur to one skilled in the relevant art having possession of this disclosure, are to be considered within the scope of the invention.

Figure 1:
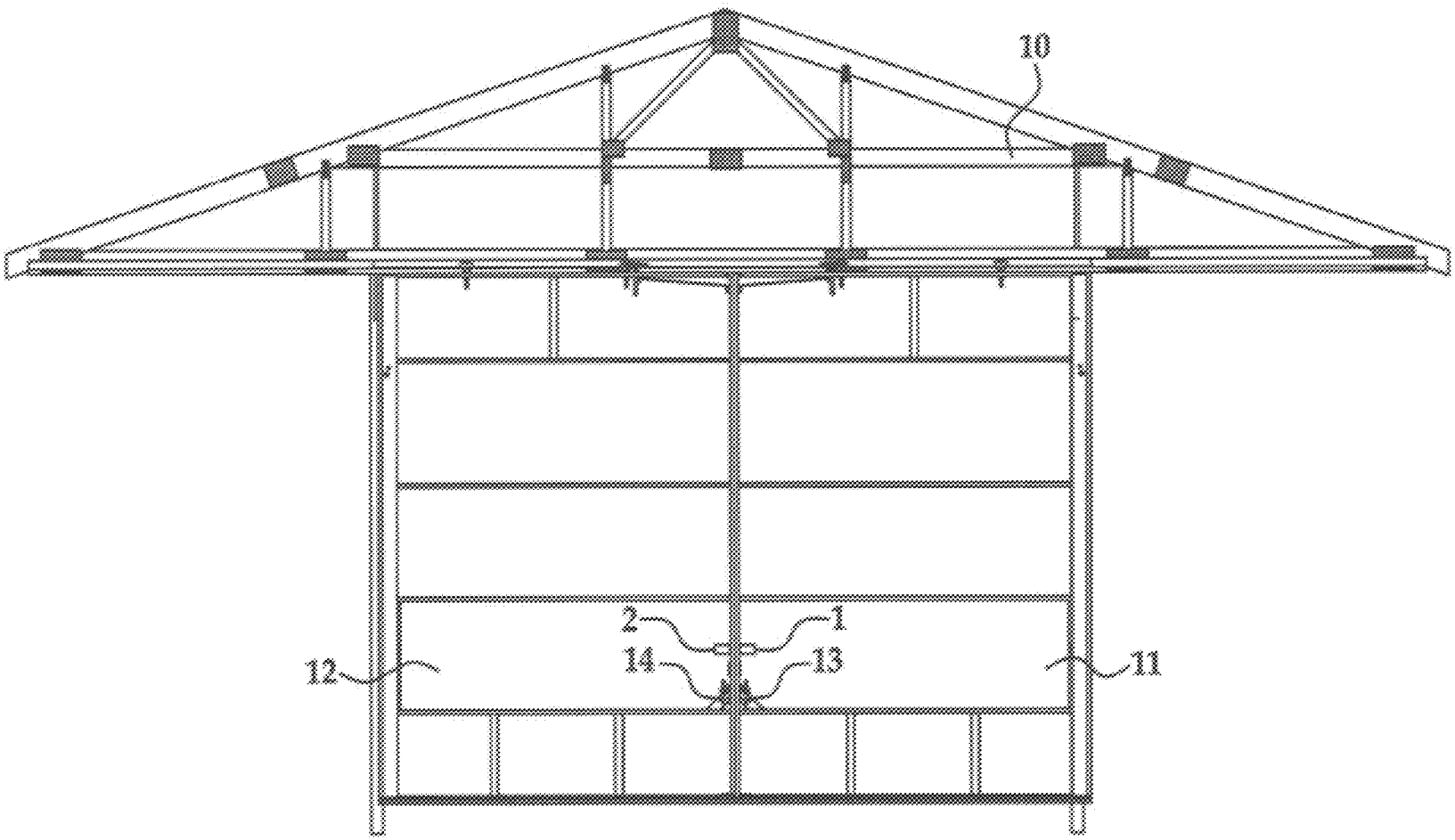
FIG. 1 is a front view of a building with a double sliding door in the closed position which includes a door latch according to the present disclosure.
Figure 2:
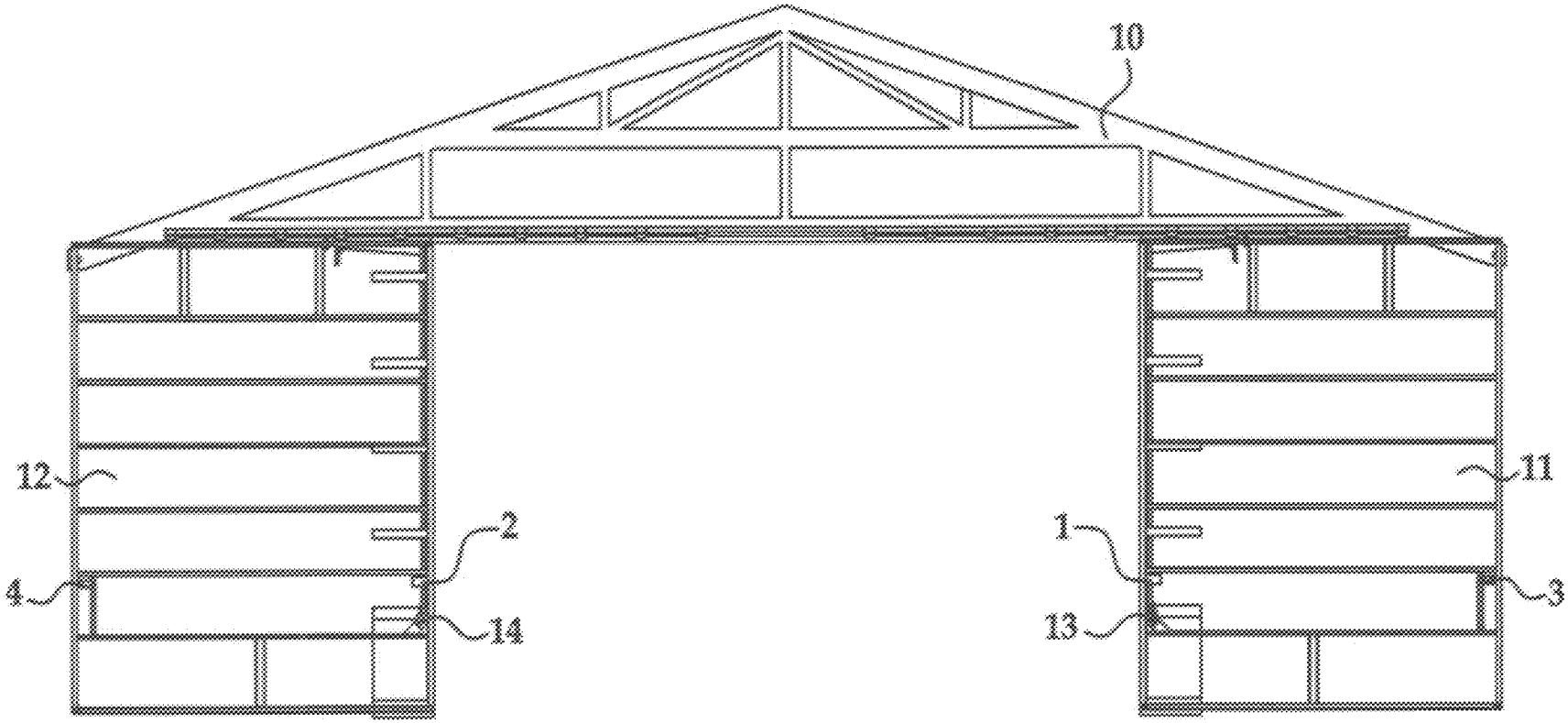
FIG. 2 is a front view of a building with a double sliding door in the open position which includes a door latch according to the present disclosure.

Referring now to FIGS. 1 and 2, there is illustrated a building 10 with a double sliding door which includes a first sliding door 11, a second sliding door 12, and a latch assembly constructed in accordance with an embodiment of the invention. In this embodiment, the latch assembly includes a right handed door latch assembly 13 which is assembled into the first sliding door 11, and a left handed door latch assembly 14 which is assembled into the second sliding door 12. As illustrated, the two doors 11 and 12 are drawn together into close proximity such that their inside facing edges are in contact with one another.

In an alternative embodiment where there is a single sliding door, the second sliding door 12 is eliminated and the first sliding door 11 slides into a fixed portion of the building 10. It should be understood that building 10 is not the only form for which the door latch assembly 13 and 14 can be used. There are a wide range of movable doors or similar movable panels, such as sliding windows and partitions, or other configurations in which a latch assembly constructed according to the invention described herein may be employed.

Figure 3A:
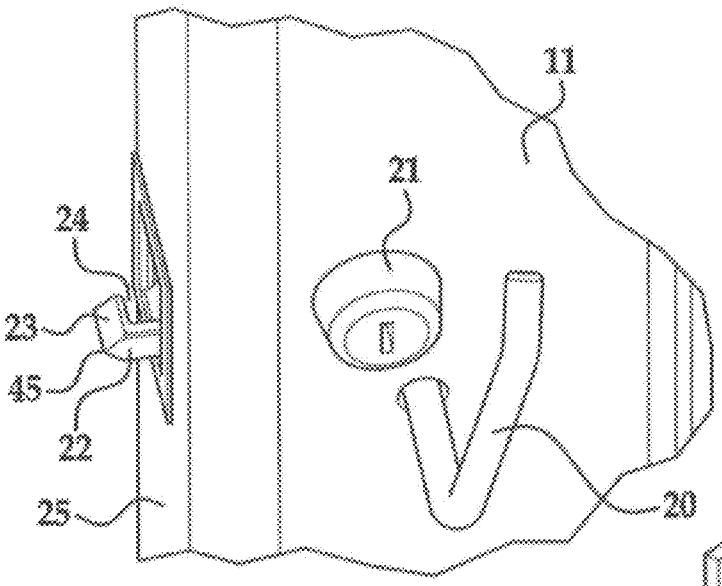
FIG. 3A is a close up perspective view of the door latch, as installed into the sliding door, showing a protruding hooked door latch extension.
Figure 7A:
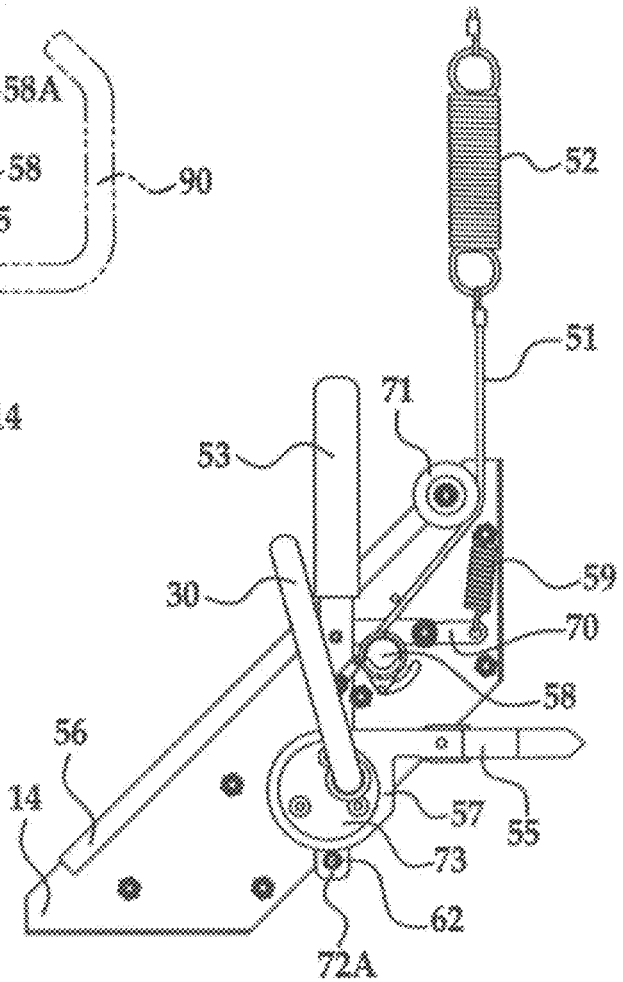
FIG. 7A is an interior view of the door latch assembly with an outer panel of the housing removed.
Figure 7B:
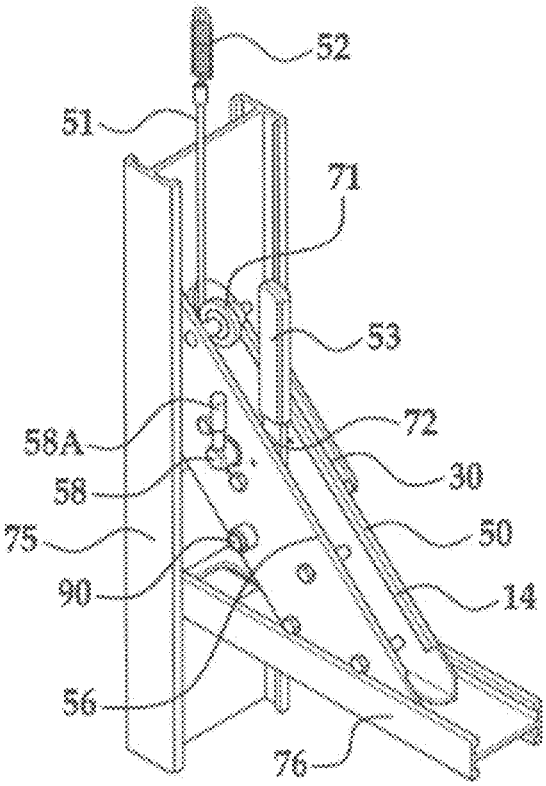
FIG. 7B is a perspective view of the door latch assembly mounted into the door frame.
Figure 8:
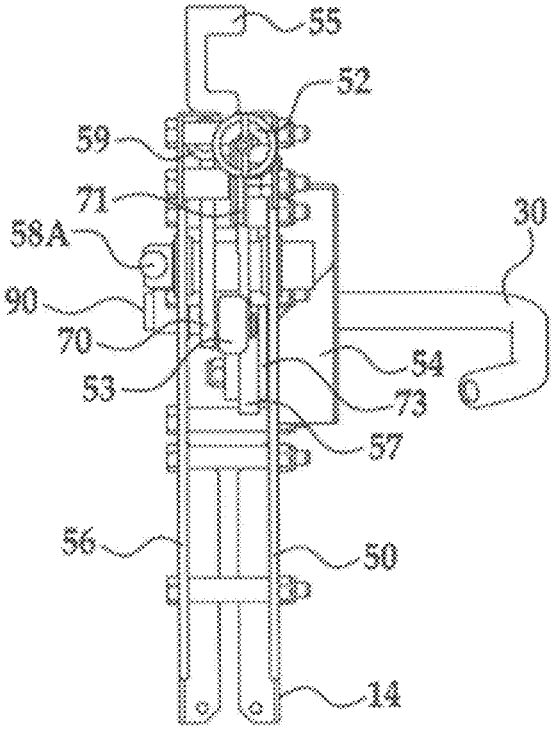
FIG. 8 is a top view of the door latch assembly.
Figure 9:
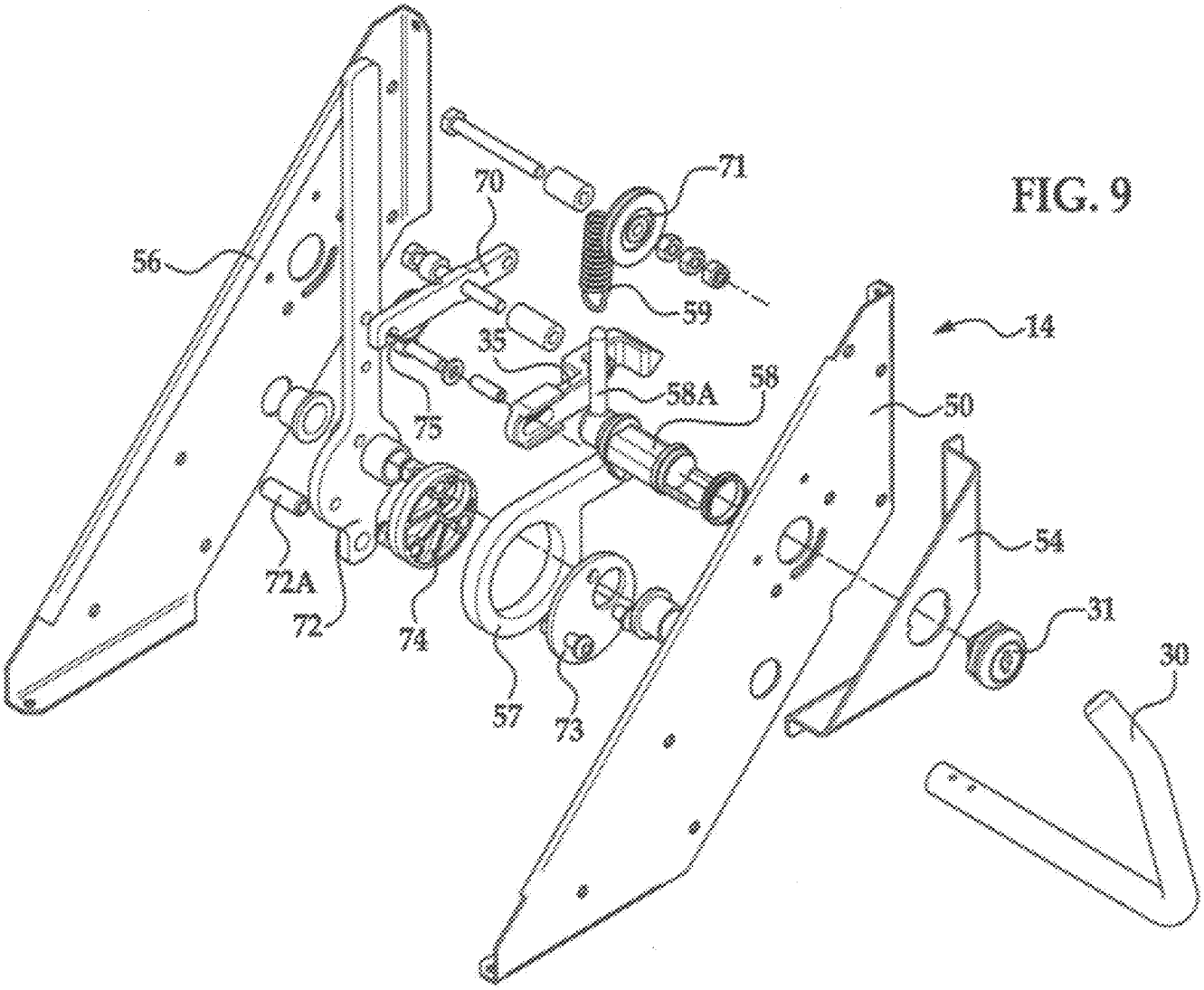
FIG. 9 is an exploded view of FIG. 1 door latch assembly.
Figure 12A:
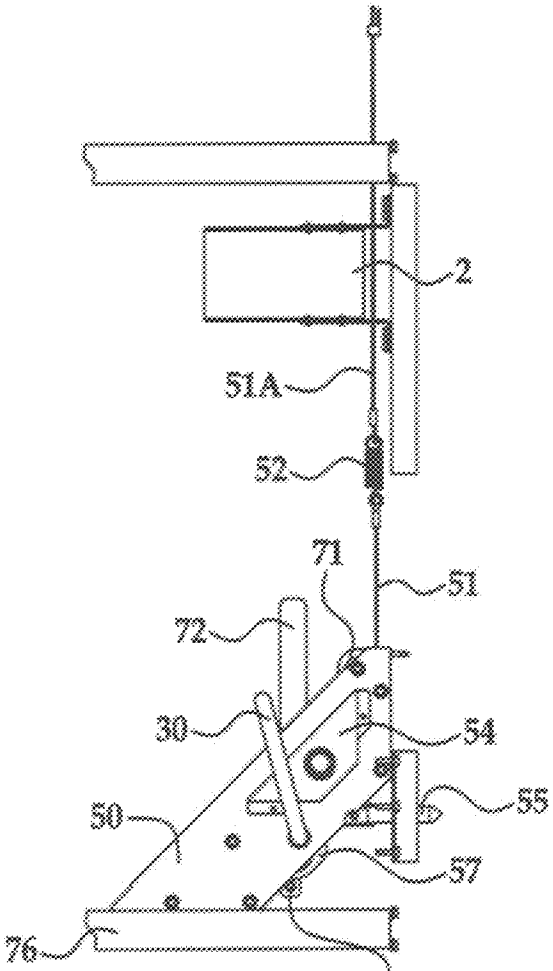
FIG. 12A is a magnified view of latch assembly with cable interconnection.
Figure 12:
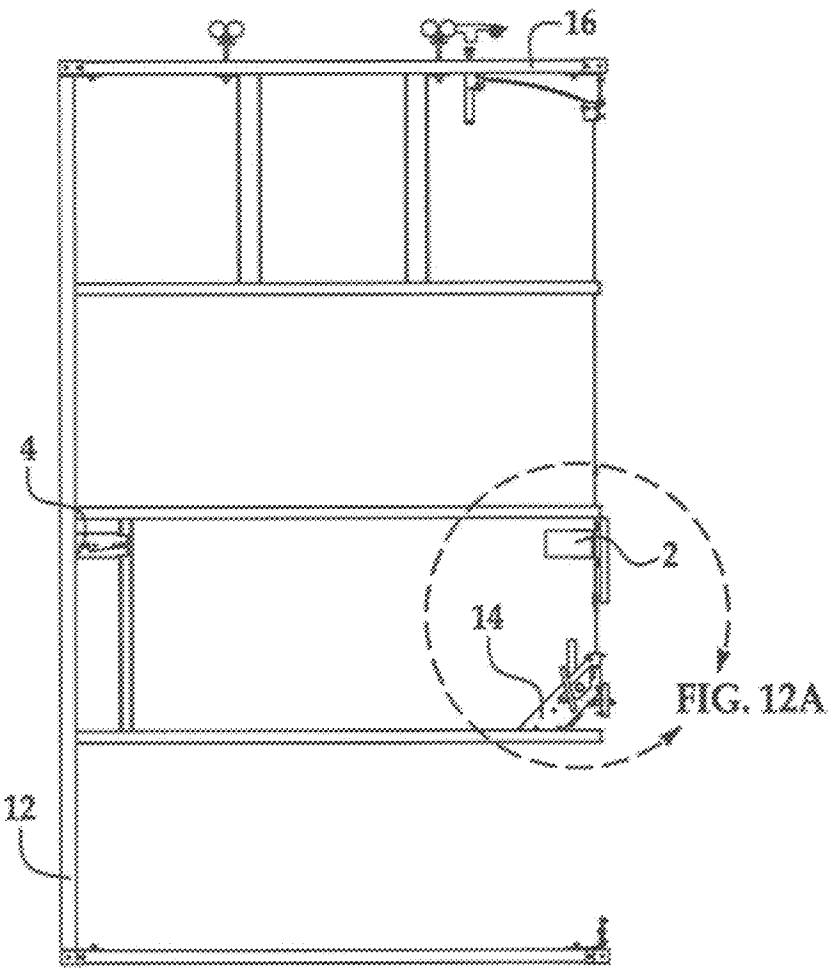
FIG. 12 is an exterior view of the latch assembly with lift rod assembly utilizing a cable for their interconnection on the interior of a door.

In FIG. 3, the hook extension 22 is illustrated as it is configured relative to the first sliding door 11 with its abutment surface 25 where the door latch 13 is assembled into the first sliding door 11. Referring to FIG. 4, the interior view of FIG. 3 is illustrated as assembled and secured into its receiving structure of the sliding door 11 with its abutment surface 25. As is illustrated, door latch 13 mounts to the inside abutment surface of the sliding door 11 and the inside surface of the first sliding door is a web structure with open spaces for receiving door latch 13 (see FIGS. 7B and 12). In FIG. 7B, illustrates the mirror image of FIG. 3. The door latch assembly 14 is positioned as close to the interior of the building as is possible on the web of the vertical support rail 75

Figure 5A:
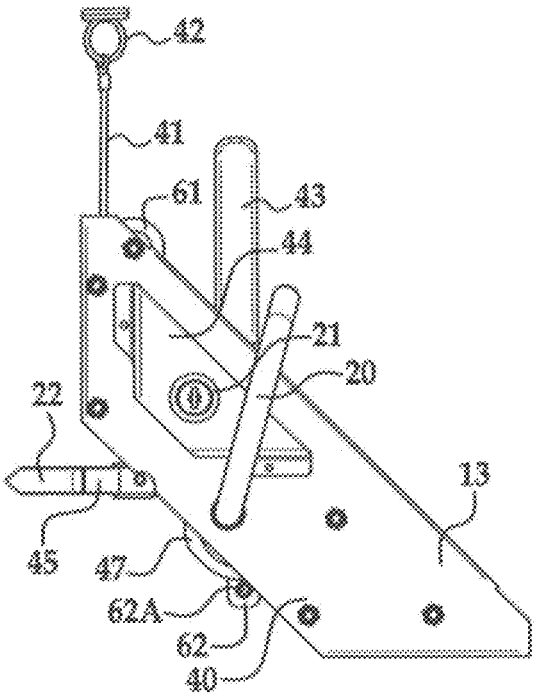
FIG. 5A is an exterior view of the door latch assembly.
Figure 5B:
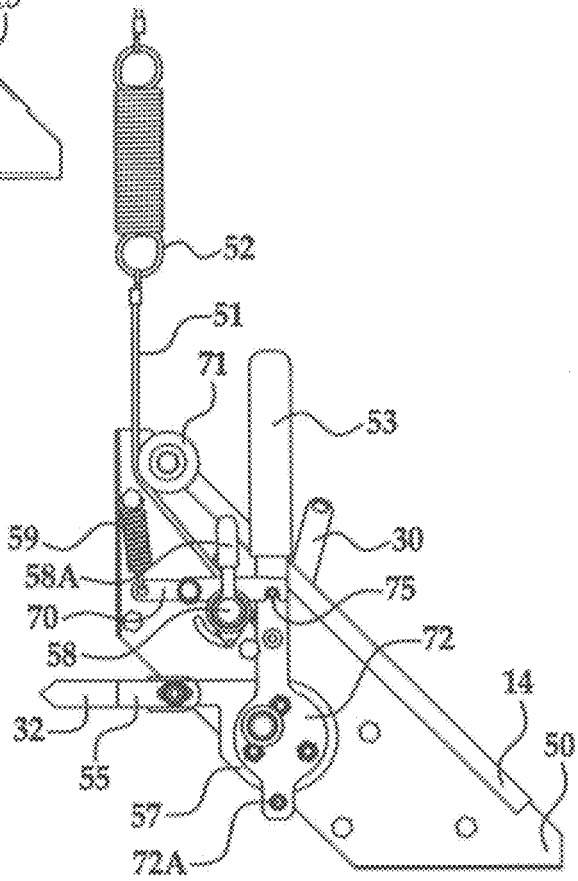
FIG. 5B is an interior view of the door latch assembly with side plate removed.
Figure 6:
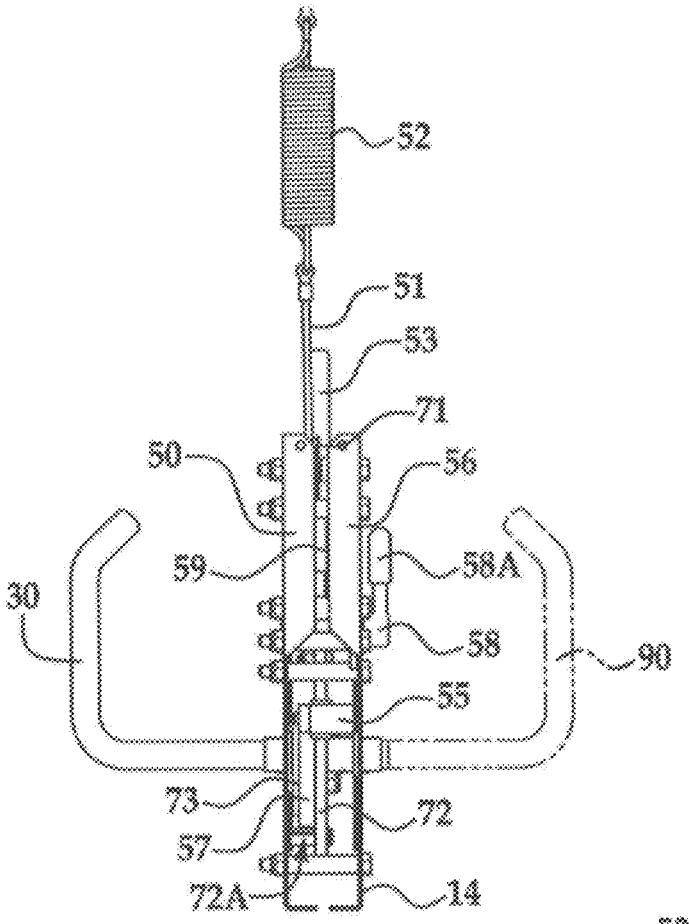
FIG. 6 is a front view of the door latch assembly.

Referring now to FIG. 5A, in order to facilitate this sliding door installation, the door latch assembly 13 has an exterior latch side plate 40, exterior door handle 20, keyed lock 21, cable 41, spring 42, inside latch handle cover 43, lock plate bracket 44, latch hook 45, interior latch side plate 46, latch pivot arm 47, and an inside latch handle 62. The lock plate bracket 44 is riveted to side plate 40. The housing is generally connected via bolts with spacers to maintain consistent spacing. Bolts provide added rigidity to housing and some degree of enclosing protection for the components assembled in between exterior side plate 40 and 50 and interior side plate 46 and 56. As such, the size and location of the bolts can be changed depending on the design preferences and the anticipated receiving door structure.

Referring now to FIGS. 5A through 9, there is illustrated a door latch assembly 13 configured as a subassembly prior to being installed into the first sliding door 11. Door latch assembly 13 includes a key-operable lock 21 whose use will be illustrated herein below. However, the key operable lock 21 has been removed from FIGS. 5B-8 in order to more clearly illustrate the other components and interior construction of door latch assembly 13.

The main securing of the door is formed with a latch hook 55, an exterior door handle 30, an optional interior door handle for use in some alternative embodiments or location therefor 90, an inside latch handle 72, pin 72A, key-operable lock 31, latch pivot side plate 73, latch pivot wheel 74, inside lock pivot 58, lock arm 70, lock spring 59, and a latch pivot arm 57. The locking function relies on a notched lock arm 70 that rotates into place with the notch 75 covering a pin connected to the inside latch handle 72. The lock arm 70 is secured by a bolt that runs through side plate 50 and 56 and the pivot point of the lock arm 70. When the notch 75 in the lock arm 70 covers the pin, the inside latch handle 72 is prevented from being able to rotate. Latch hook 55 connected to the inside latch handle 72 through the latch pivot wheel 74 and latch pivot arm 57 is in a position that will allow it to stay latched or allow the latching action to occur. When the lever is prevented from rotating, the interior and exterior handles will not actuate, thus locking the door.

The lock arm 70 maintains pressure over the top of the pin by means of a lock spring 59 attached to the opposite end from the notch on the lock arm. The securing of the latch assembly 14 is spring biased, with lock spring 59 tending to pull the lock arm 70 in a downward direction. The moment imparted to the lock arm 70 ensures that the locking function stays secure over the pin unless acted upon by the pivoting inside lock pivot 58. The inside lock pivot 58 is constructed such that its cylindrical body has a half circle section protruding from the body. The inside lock pivot 58 operates in two positions. In the locked position it allows the lock arm 70 to rest flat across inside lock pivot 58, such that the notch 75 in the lock arm 70 rests over the pin in the inside latch handle 72. In the second unlocked position, as the inside lock pivot 58 rotates into the unlocked position it acts as a cam pushing up against the spring force of the lock arm 70 and raising it up so that there is enough clearance for the pin on the inside latch handle 72 to pass freely beneath the notch and allows actuation of the latching mechanism.

In this embodiment, the inside lock pivot 58 can be rotated by either of two methods. The first method is operated from the exterior of the building. It relies on a key operable lock 31 that is attached to the lock plate bracket 54. The key operable lock 31 protrudes from the interior of the door to the exterior of the door. As the door operator turns the key the key operable lock 31 rotates the inside lock pivot 58. The second method of rotating the inside lock pivot 58 is achieved from the interior side of the door. This method rotates the inside lock pivot 58 by means of a lever 58A directly attached to the inside lock pivot 58.

The exterior rotation of a key in the key operable lock 31 or the rotation of the inside lock pivot 58 from the interior forces the lock arm to release the inside latch handle 72. With the lock arm released, this allows for the rotation of either the interior or exterior latch handle to rotate. The exterior door handle 30 is mounted in the bushings that are pressed into the latch assembly 13 housing made up of side plate 50 and 56. Exterior door handle 30 extends through a hole so as to permit pivoting movement of the latch hook 55. The inside latch handle 72 is mounted on and connected to the exterior door handle 30 and interior door handle. This configuration of exterior handle rod 30 allows the rod to freely turn or rotate within the receiving holes in the outer and inner panels 50 and 56. Connecting them in this way also allows both the inside latch handle 72 and exterior door handle 30 to rotate around the same axis together, so rotating one handle will also rotate the other handle once the lock arm 70 has been disengaged.

Once lock arm 70 is released, the rotation of either handle rotates the inside latch handle 72, which rotates a cam called the latch pivot wheel 74, this cam rotates pin 72A, and pin 72A pushes the latch pivot arm 57 forward and up, thus lifting the latch hook 55 up and over the latch hook 45. The inside latch handle 72 is connected to the latch hook 55 by means of the latch pivot wheel 74. As the latch pivot wheel 74 continues to rotate, pin 72A connected to the bottom of inside latch handle 72 and comes into contact with the latch pivot arm 57 pushing the latch hook 55 up and over the other latch hook 45 as the lever completes its rotation. This allows the operator to pull the door open because both the lock arm 70 and the latch hook 55 connected to the inside latch handle 72 are clear of their respective catches. The interior side of the latch assembly 14 does not have a keyed lock like the exterior, but instead it has an inside lock pivot 58. In an alternative embodiment, the optional interior door handle 90 may be added, if for example, access to the inside latch handle cover 53 is limited.

The latch hook 45 is one of the component parts in the door latch assembly 13, and the latch hook 55 is one of the component parts in the door latch assembly 14. When the two sliding doors are drawn together, either latch hook is lifted up and inserted into clearance slot 34 and 24 (see FIG. 12). The door cannot slide apart without either latch hook 45 or 55 being lifted to a height where the sliding apart movement is not hindered by the back side of the ramped surface 23. Either hook extension can be released when the door handle is rotated. If exterior door handle 20 is rotated, the latch hook 45 lifts up and the sliding door 11 becomes unlatched from sliding door 12. Alternatively, in order to latch the arms, the latch hook 45 is lifted by the ramped surface 33 of the latch hook 55 and slides into clearance slot 34 and completes the securing together of the two doors 11 and 12.

Figure 3B:
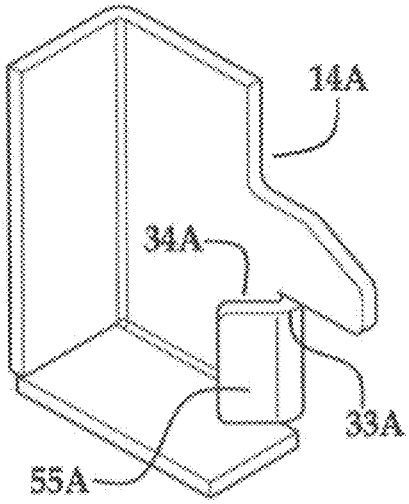
FIG. 3B is a perspective view of the single door catch plate.
Figure 4:
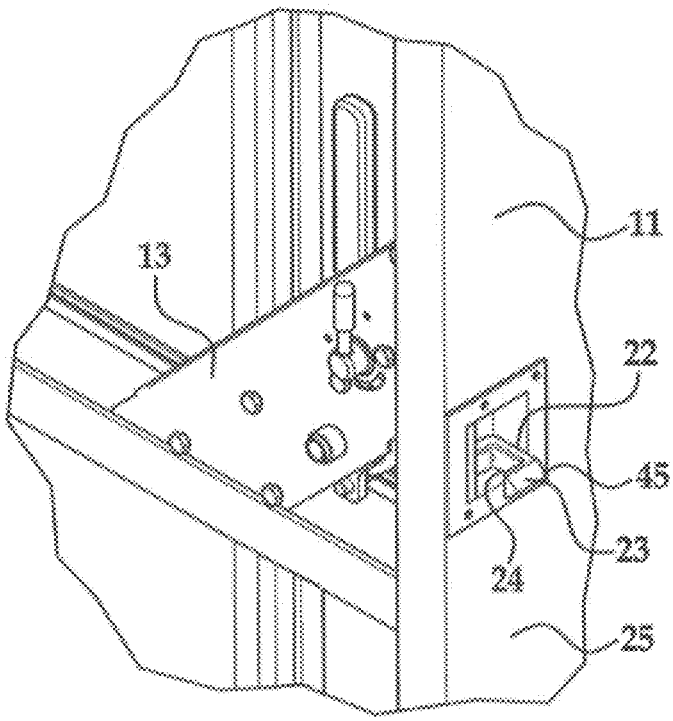
FIG. 4 is a close up perspective view of the interior side of the sliding door showing the matched protruding hooked door latch extension.

Referring now to FIG. 3B, an alternative embodiment includes a stationary single door catch plate 14A secured to the abutment surface of a building, such as the surface of the door jamb, in a position for receiving the latch hook 45. When the single sliding door is drawn towards the building surface, latch hook 45 is lifted up over surface 55A through contact between surface 23 and surface 55A as the door is moving thereto, and latch hook 45 falls into place within clearance slot 34A with surface 55A accommodated by clearance slot 24. The single sliding door cannot slide without latch hook 45 being lifted to a height where the sliding apart movement is not hindered by the back side of curved surface 33A. Latch hook 45 can be released when the door handle 20 is rotated, and the latch hook 45 lifts up and the sliding door 11 becomes unlatched from the stationary single door catch plate 14A.

Figure 10:
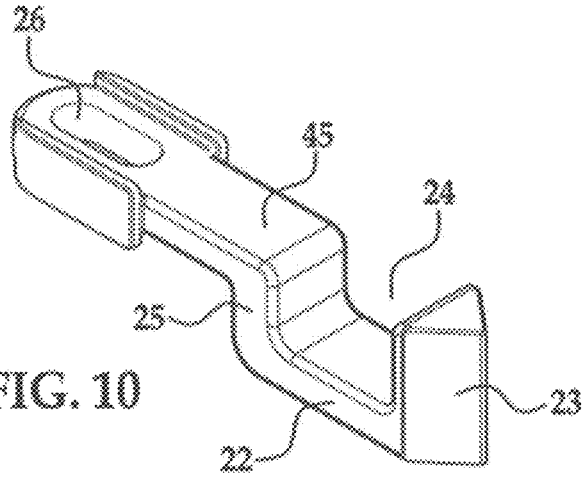
FIG. 10 is a perspective view of the hooked door latch.
Figure 11A:
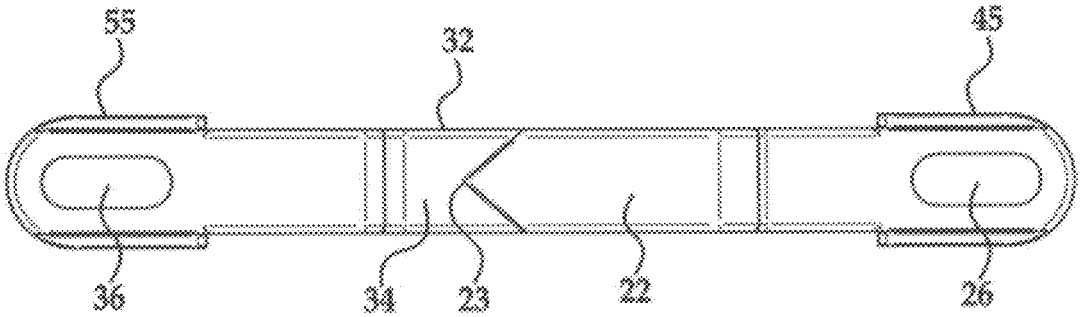
FIG. 11A is a side view of the hooked door latches in their locked configuration.
Figure 11B:
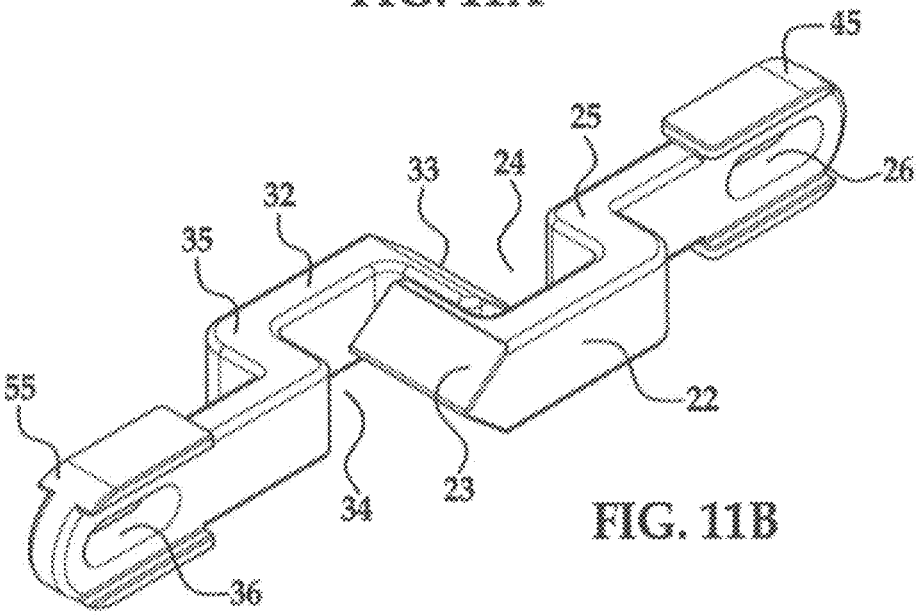
FIG. 11B is a perspective view of the hooked door latches as formed for use in the locked configuration.

Referring now to FIG. 10 through 11B, latch hook 45 is comprised of connecting slot 26, edge portion 25, clearance slot 24, hook extension 22, ramped surface 23. The latch hook is separated into 3 parts: front, intermediate, and end portions. In FIG. 10, the front end of latch hook 45 has a double sided angled ramp that allows either hooks to slide over the top of each other as they come in contact. The intermediate portion of latch 45 where the hook extension 22 is, determines the length of the hooked front portion. The edge portion 25 is not as long as the front hooked portion, and this portion includes a connecting slot 26 that connects to latch pivot arm 48 via a bolt. In FIGS. 11A and 11B, once a latch hook has slid over the top of the matching component it falls behind the front of the latch hook into clearance slot 24 and 34 and this forms a catch. The back face of the front ramped surface 23 hooks to the back surface of ramped surface 33 to form the catch. As see in FIG. 11B, the latch hooks are parallel to each other, and the clearance slot 24 can be a tighter fit to prevent doors from sliding back and forth, which would secures the door in place.

Figure 13A:
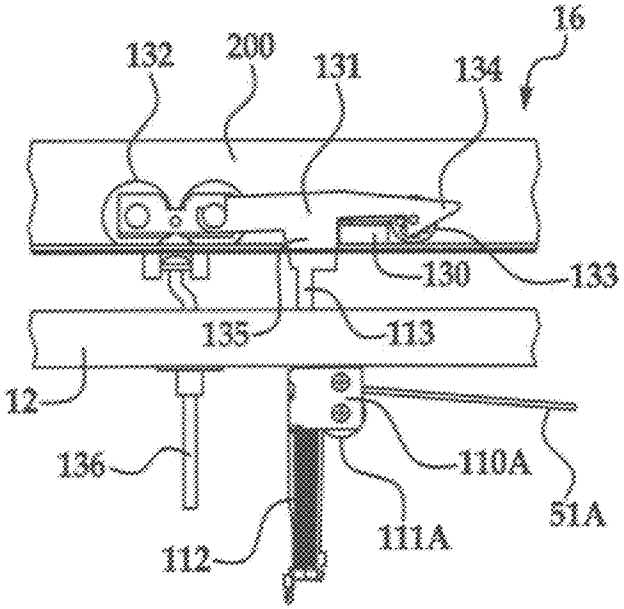
FIG. 13A is a magnified view of lift rod and plate latch mechanism.
Figure 13:
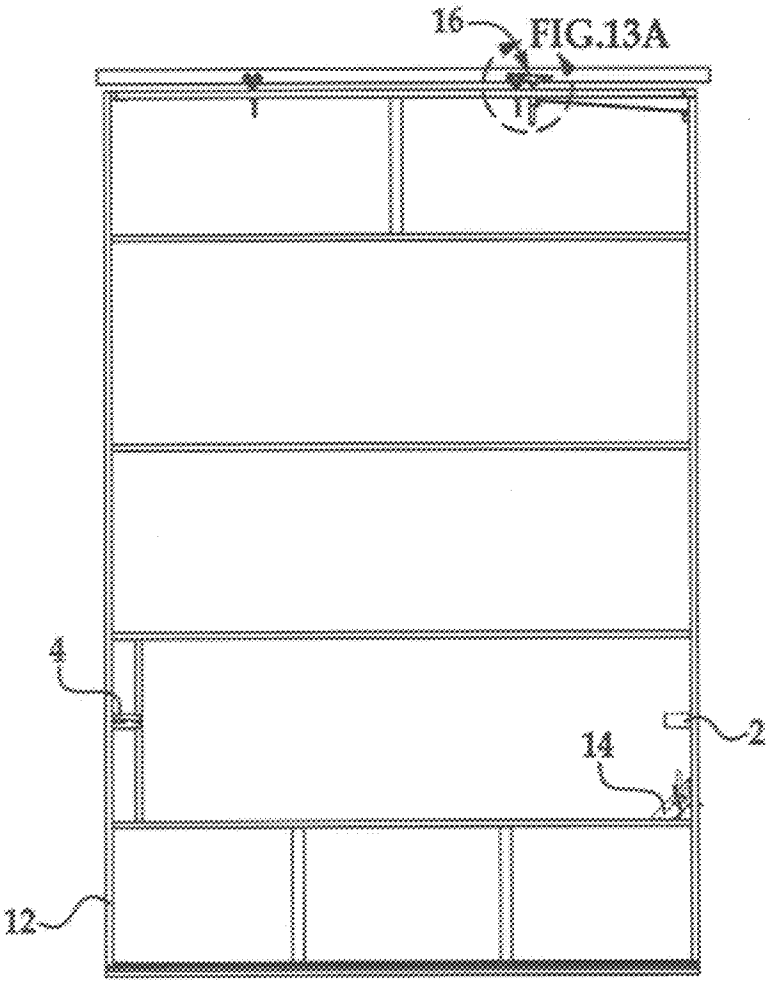
FIG. 13 is an exterior view of the door magnifying the lift rod assembly utilizing a cable for the interconnection with door latch assembly.

In another embodiment, the door is secured by two latch mechanisms: the latch assembly 14 and the overhead track latching mechanism. The overhead track latching mechanism is comprised of the latch mechanism plate 131 and the lift rod assembly 16. In FIG. 7A, the lift rod assembly is attached to the inside latch handle 72, by means of wheel pulley 71, cable 51, and cable spring 52. FIG. 13 shows sliding door 12, and the cable system that attaches to the overhead track latching mechanism. Cable spring 52 is further connected by cable 51A to the lift rod assembly 16

Figure 14:
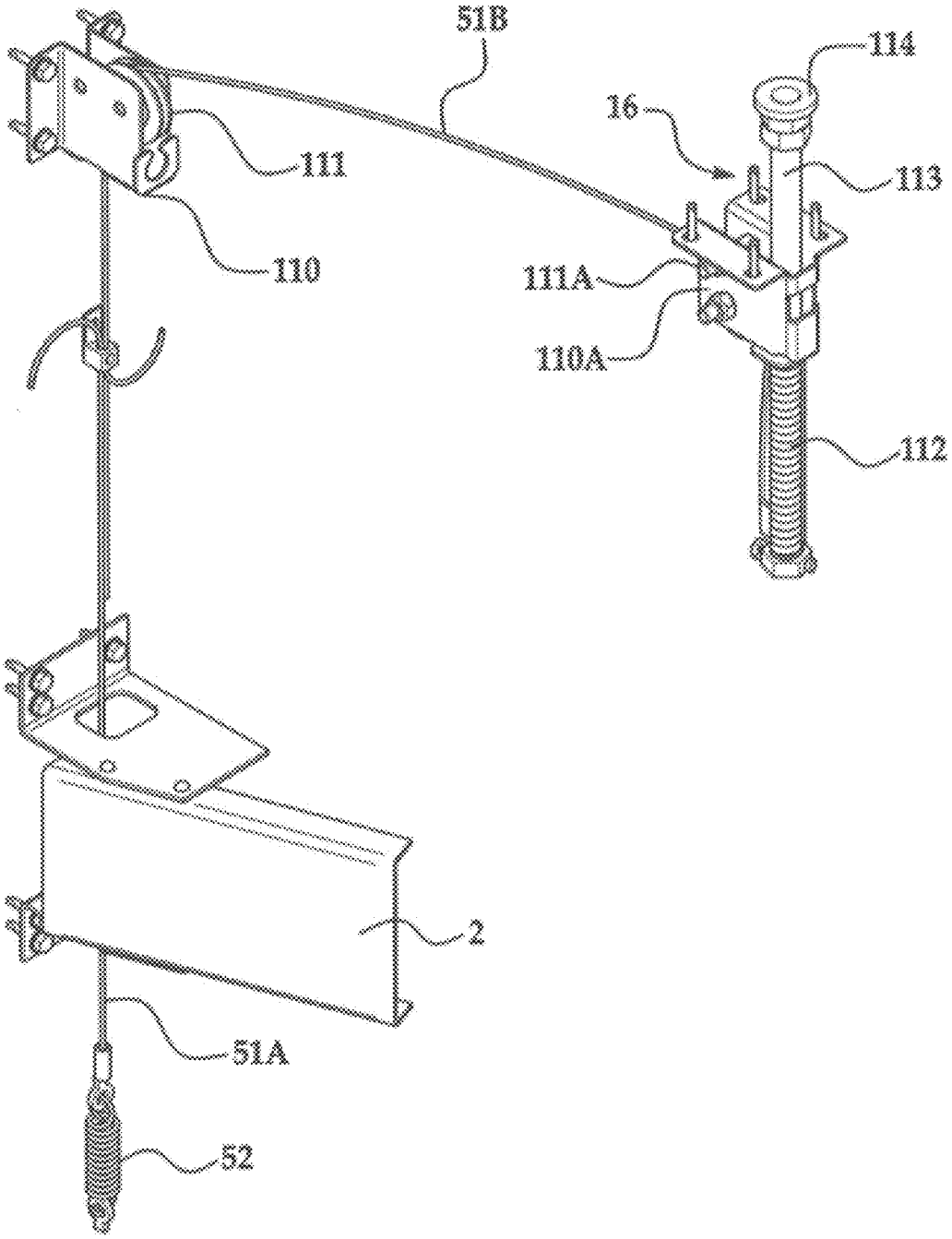
FIG. 14 is an exterior view of the lift rod assembly with the door frame missing.
Figure 15:
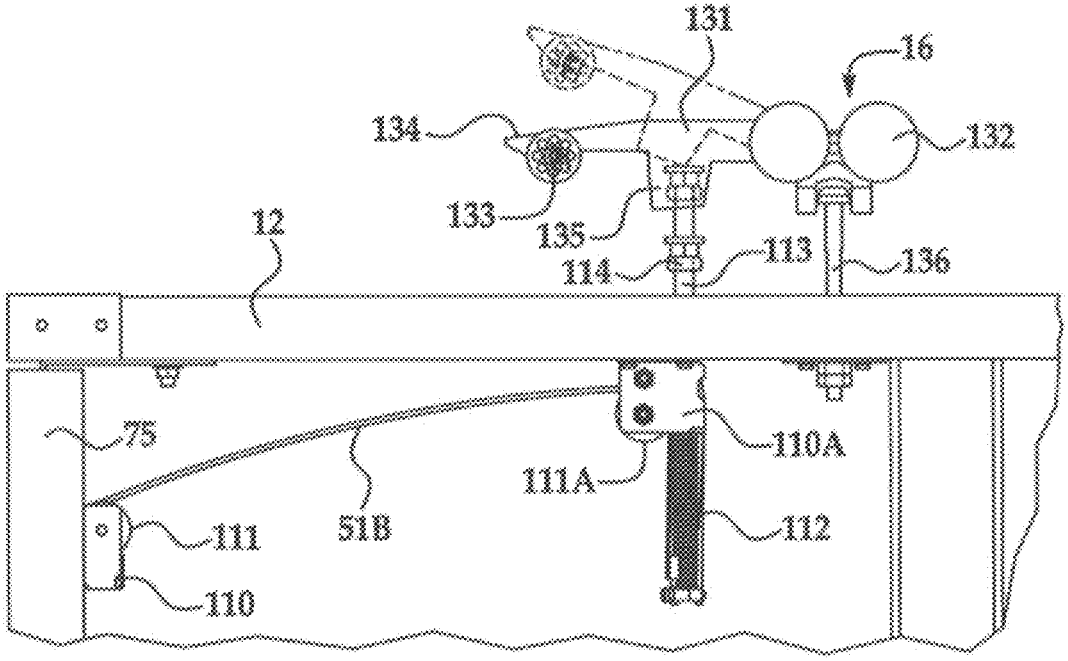
FIG. 15 is an exterior view of the lift rod assembly movement within the track.
Figure 16:
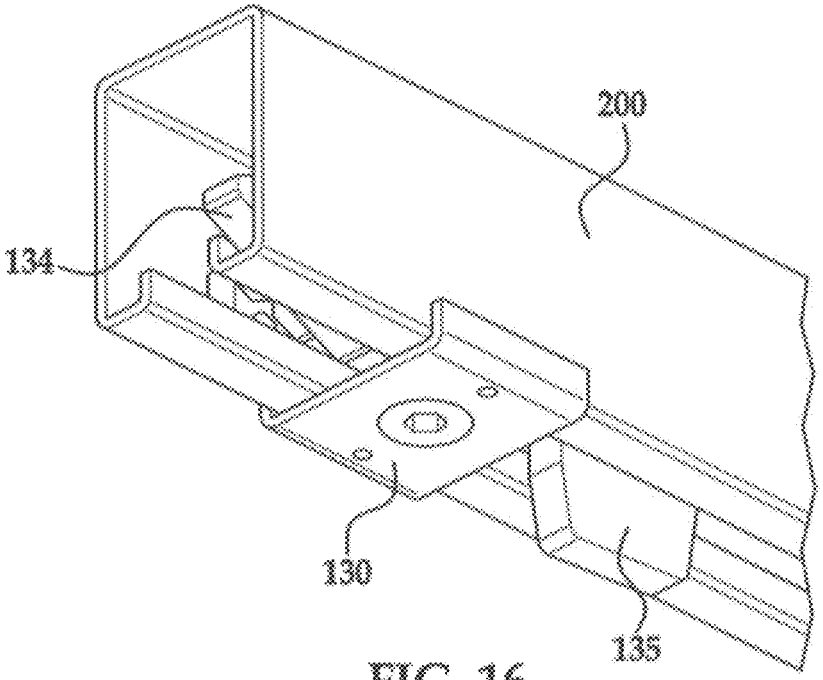
FIG. 16 is a perspective view of the trolley track illustrating the secondary stop.

Referring now to FIG. 14 through 16, the lift rod assembly 16 is made up of: cable 51B, pulley wheel 111 and 111A, pulley bracket 110 and 110A, compression spring 112, rod 113, bolt end 114, overhead track 200, secondary stop 130, latch mechanism plate 131, track wheel assembly 132, support rod 136, and ramp wheel 133. The door is primarily stopped by the center door guide in the closed position.

In this embodiment as shown in FIG. 13, the left handed sliding door lift rod assembly 16 works in conjunction with the latch assembly 14 to secure the door when the latching mechanism plate 131 slides over a secondary stop 130 by means of its ramp face 134 by falling into a catch created by the secondary stop 130.

The latch mechanism is attached to inside the overhead track 200 connecting the sliding door 12 by means of a support rod 136. The latch mechanism plate 131 hooks around the axel of the trolley wheel assembly 132 on one side and has a ramp face 134 on the other side. The ramp face 134 has a ramp wheel 133 to allow it to roll easily through the track. There is a secondary stop 130 fixed in the track (see FIG. 17). As sliding door 12 is sliding closed, the ramped end of latch mechanism plate 131 is forced up and over the secondary stop 130. Behind secondary stop 130 is a space that acts as a catch. As the ramp face 134 slides via the ramp wheel 133 up and over the stop, as the latch mechanism plate 131 is still secured to the trolley. As the ramp face 134 passes the secondary stop 130 gravity pulls it down securing it. The latching mechanism plate 131 is secured by secondary stop 130 and because it is also secured to the trolley wheel assembly 132 at the axle, sliding door 12 is prevented from traveling along the track The compression spring 112 in the lift rod assembly 16 also serves the purpose keeping the bolt in a starting position. The bolt 113 is normally down and out of the overhead track 200, so that sliding door 12 can move freely in between the open and closed positions. To unlatch the in track latch mechanism plate 131 from the secondary stop 130, either interior or exterior door handle needs to be rotated. This action rotates the inside latch handle 72, which connects via cable 51 through a system of pulleys to the compressions spring 112 in the lift rod assembly 16. The wheel pulley 71 and the pulley wheel 111, and 111A are each connected by a cable 51. Pulley wheel 111 and 111A are faceted by means of the pulley assembly to vertical 75 and top horizontal beam of sliding door 12, respectively. Cable 51B draws a spring loaded bolt 113 up and into the track (See FIG. 16). The bolt end 114 of the spring loaded bolt 113 in the lift rod assembly 16 pushes the latch mechanism plate 131 via lower portion 135 in the overhead track 200 up and over the secondary stop 130 so that the trolley wheel assembly 132 and latch mechanism plate can be released, and the door 12 can continue to slide along the overhead track 200.

The cable spring 52 attached to the cable 51 that connects the inside latch handle 72 to the spring loaded bolt 113. The cable spring 52 is preferably stiffer than the compression spring 112 in spring loaded bolt 113. The stiffer cable spring 52 allows it to act as a part of the cable in transferring force to unlatch the sliding door 12 in the track. The inside latch handle 72 may be designed to rotate farther than necessary to help ensure the latch assembly 14 unlatches. Once the inside latch handle 72 has pulled the cable 51 far enough that the bolt 113 can no longer travel upward, the stiffer cable spring 52 will extend. This protects cable 51 from damage in over-rotating the lever, among other things In another embodiment, the operation of unlocking the latch mechanism plate 131 relies upon pressurized air to provide the force necessary for actuating the in track lift rod assembly 16. The pneumatic method of operation for the lift rod assembly 16 replaces mechanically actuated lift rod assemblies 16. An exterior and interior handle may operate the latch hooks as described by the pulley system. However, instead of pulling on a cable attached to pulleys, the handle compresses air in a cylinder as it is actuated. This compressed air operates a pneumatic cylinder at the top of the sliding door 12 and is directed to push the latch mechanism plate 131 up and over the secondary stop 130. The rod end 114 pushes the latch mechanism plate 131 up and over the secondary stop 130 (see FIG. 15). As the handle that operates the compression cylinder returns to the starting position, the pressure in the compression cylinder reduces and the lift rod cylinder is allowed to return down and into the starting position. In some embodiments, it is envisioned that the air pressure that returns the compression cylinder to the starting position will also return the inside latch handle 72 and therefore the latch hook 55 to their nominal positions. In other embodiments, the cylinder may be of an internal spring return type or a standard pneumatic cylinder used to power the lift rod cylinder.

In another embodiment, the door is further secured by another latch mechanism, that is, a retaining subsystem. The retaining subsystem of this embodiment is comprised of retainer assembly 18, retainer ramp 2, and a retainer catch 4. The retaining function serves to keep sliding door 12 in the fully open position and prevent the door from sliding along the track. In a bi-panel two sliding door configuration, there may be two such retaining sub systems. The retainer assembly works in conjunction with a retainer roller ramp and a door catch to create a secure latch.

Figure 17A:
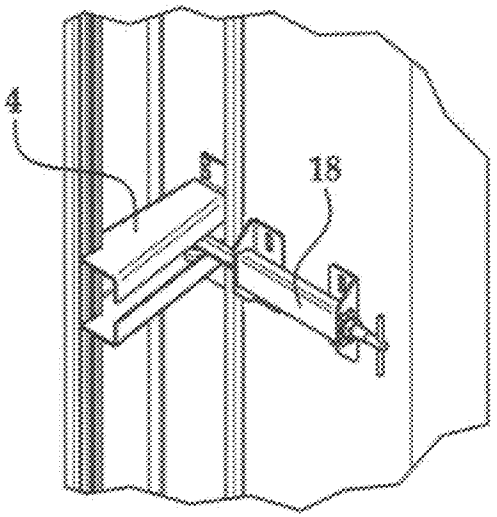
FIG. 17A is a magnified view of retainer and retainer catch.
Figure 17:
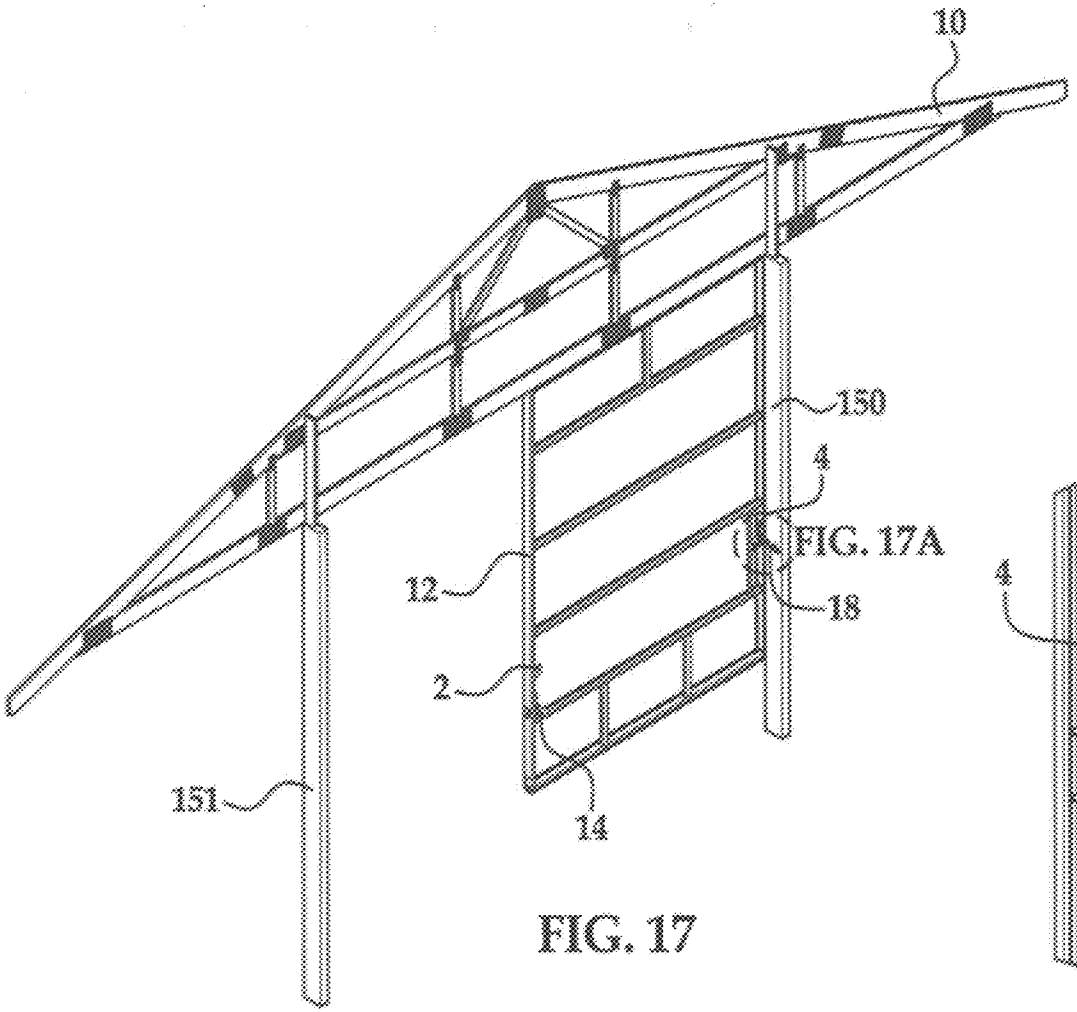
FIG. 17 is an interior view of the retainer and the retainer catch.
Figure 18A:
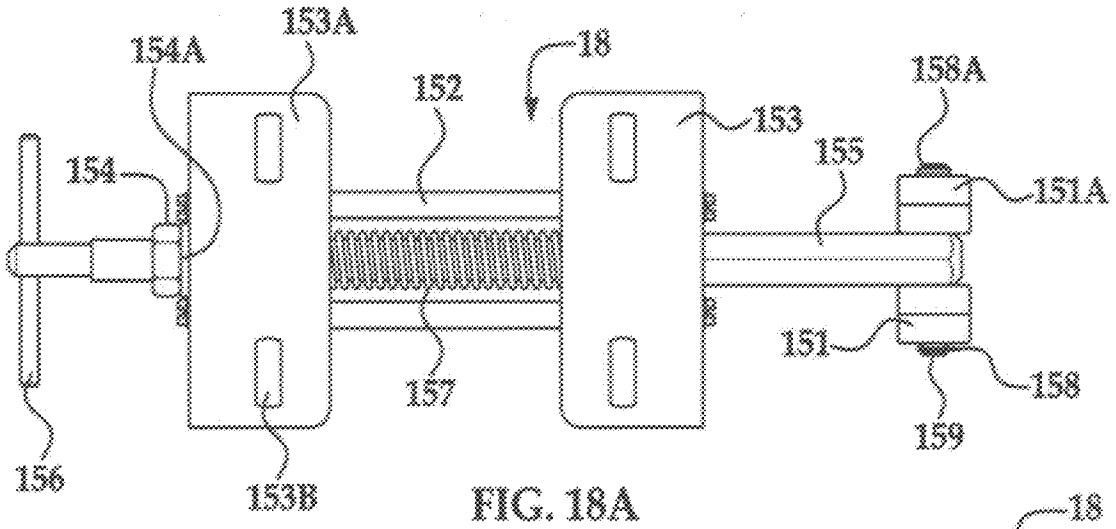
FIG. 18A is a bottom view of the retainer.
Figure 18B:
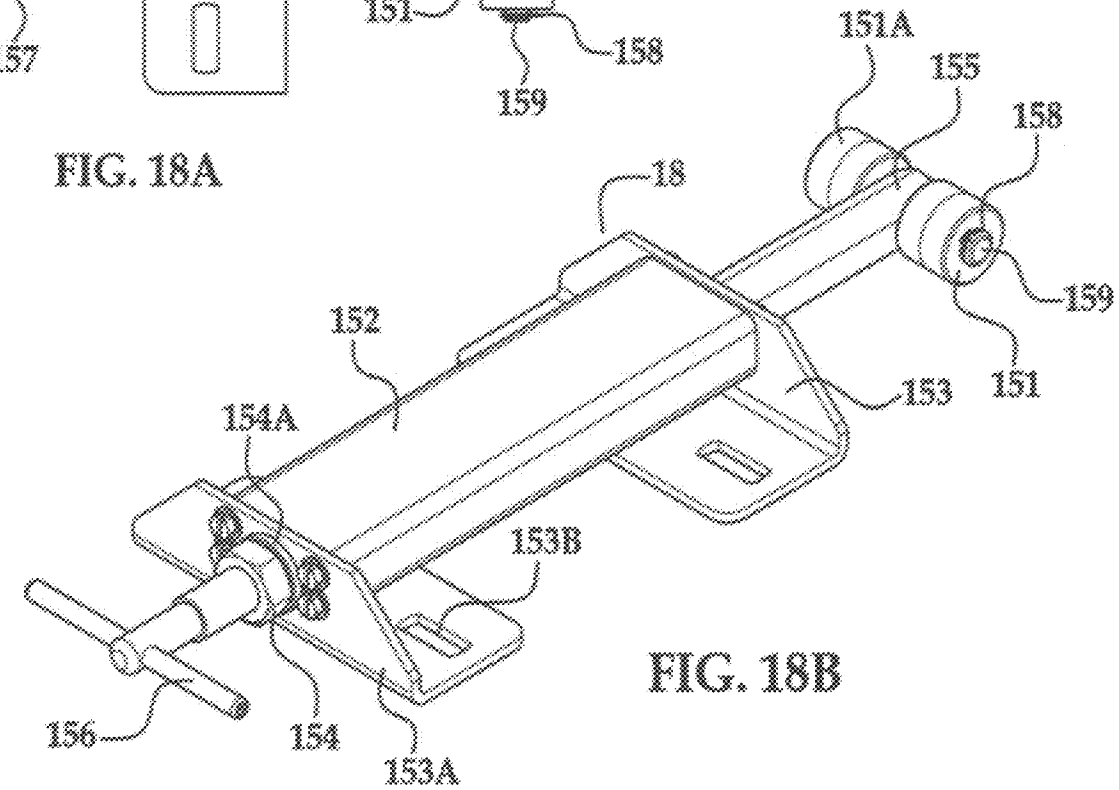
FIG. 18B is a perspective view of the retainer.

Referring now to FIG. 17 through FIG. 18B, the retainer assembly is a spring loaded retainer bolt 155 mechanism attached to the door jamb 150. The retainer is comprised of: retainer roller 151 and 151A, extrusion housing 152, retainer end cap 153 and 153A, mounting point 153B, nylock nut 154, press fit bushing 154A, retainer bolt 155, retainer pin 156, retainer compression spring 157, e-clip 158 and 158A, and a retainer roller pin 159

The exterior facing retainer end cap 153 has a polygonal hole for the hex bolt to pass through and prevent rotation along the axis of the retainer bolt 155. A retainer pin 156 is inserted at the end of the cylindrical portion of the retainer bolt 155 perpendicular to the axis of the bolt, but parallel to the door jamb 150 in order to act as a handle for unlocking the mechanism. The polygonal side of the retainer bolt 155 extends past the door jamb 150 into the sliding door between horizontal support rails of the sliding door 12. That end of the retainer bolt 155 has the retainer roller pin 159 inserted through a hole near the tip that is perpendicular to the axis of the bolt and parallel to the door jamb 150. The retainer roller pin 159 is inserted to the end of the polygonal side of the retainer bolt 155 and serves as an axel for the retainer roller 151 and 151A. One roller is attached to each side of the retainer bolt 155 via e-clip 158 and 158A. E-clip 158 and 158A are used to retain the rollers on the retainer roller pin. Retainer roller 151 and 151A are free to spin around the axis of the retainer roller pin 159 on which they are mounted.

The retainer compression spring 157 allows retainer bolt 155 to move freely in and out. The retainer bolt 155 is pushed out in the direction of the exterior of the building by the spring force and when fully extended it would be considered the starting position for the retainer bolt 155. The retainer bolt 155 should not be circular in nature so as to prevent the bolt from rotating within the retainer assembly, it is envisioned to be polygonal, for example: a triangle, square, pentagon, oval, composite or oblong shape all could be used to prevent rotation. In FIGS. 18A and 18B, illustrates the retainer bolt 155 with a hexagonal shaped end and a circular shaped end. The retainer end cap 153 prevents the retainer bolt 155 from rotation by providing a track or channel in the polygonal shape that the retainer bolt 155 travels through. To mount the entire retainer assembly the retainer end caps 153 and 153A have slots that serve as mounting points so that the retainer assembly 18 can be attached to the door jamb 150. Mounting point 153B is illustrated.

The end of the retainer bolt 155 that faces the interior of the building is threaded to provide adjustment in and out by rotating the nylock nut 154 that presses against the press fit bushing 154A and end cap 153A. This adjustment allows the end of the retainer bolt 155 facing the exterior of the building to stick out an optimum distance past the door jamb 150. The press fit bushing 154A is flange shaped to help ensure the threaded portion of the retainer bolt 155 will not become jammed against interior retainer end cap 153A. The retainer roller 151 and 151A do not have to touch the interior of the sliding door 12. The housing of the retainer assembly 18 consists of an extrusion 152 with a retainer end cap 153 and 153A fastened to each side (see FIGS. 18A and 18B). The interior facing end cap has a round hole with a bushing pressed into it. The retainer bolt 155 passes through the bushing to allow smooth linear motion for the bolt to move in and out.

Figure 19A:
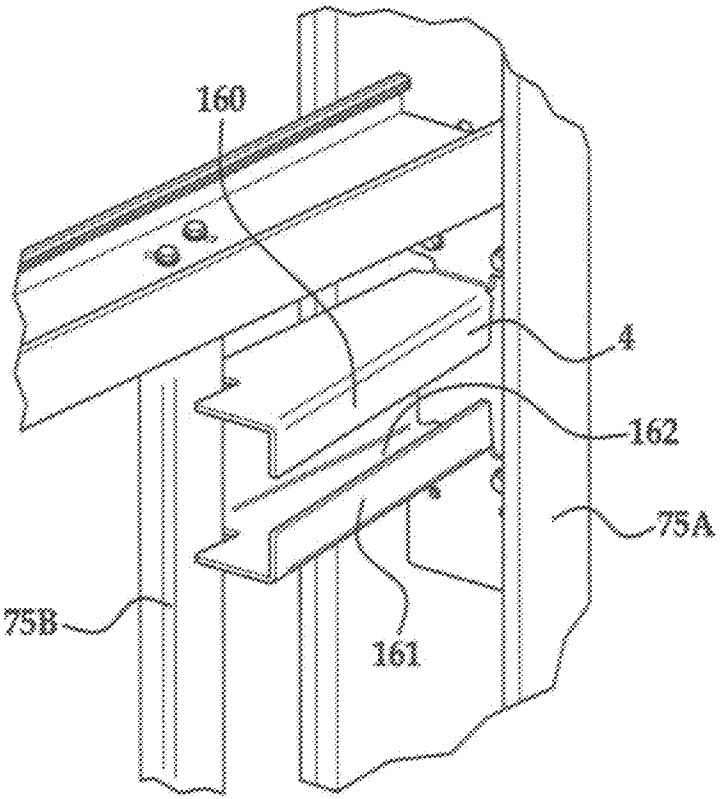
FIG. 19A is a magnified view of the retainer catch.
Figure 19:
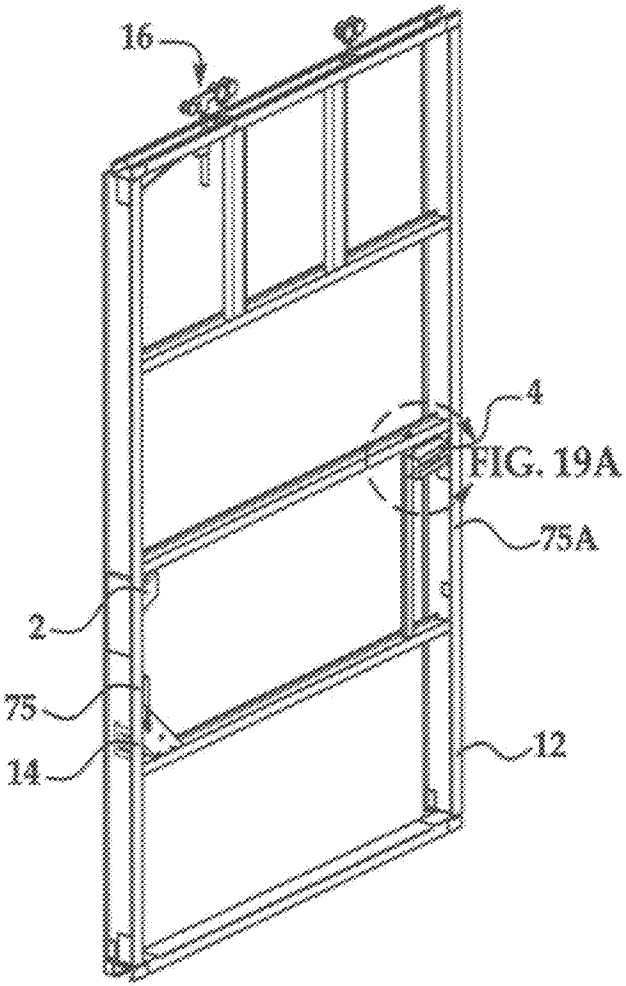
FIG. 19 is an interior view of the door including the retainer catch.
Figure 20:
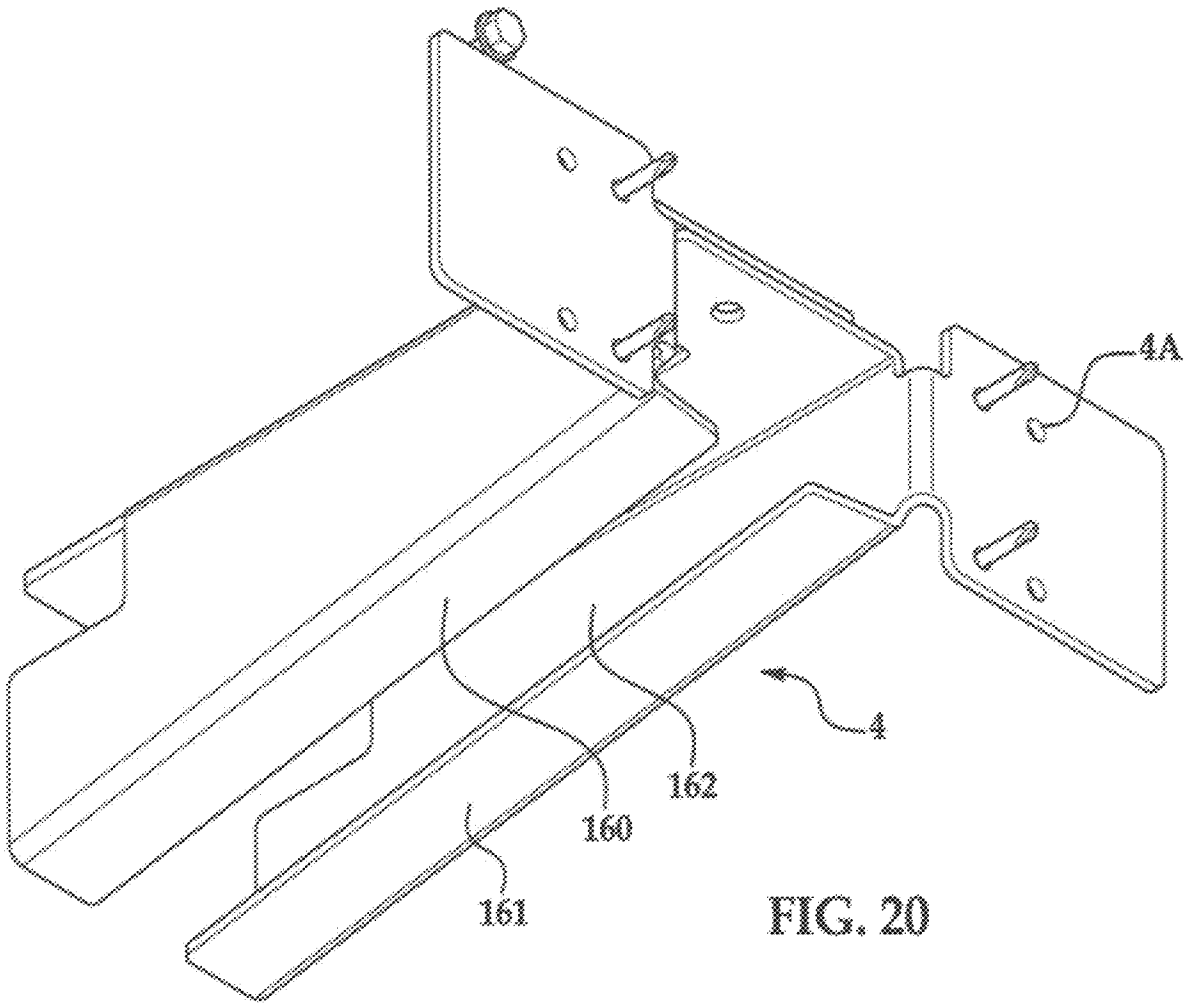
FIG. 20 is a perspective view of the retainer catch.

Referring now to FIGS. 19 and 20, which illustrate a retainer catch 4 and a vertical support beam 75B designed to be used with the retainer assembly in order to prevent the door from pulling away from the building while the door is in the closed position, among other things, constructed according to some embodiments of the invention.

In this embodiment, the retainer catch 4 is mounted in the web of vertical support beams via eight slots or holes (similar to slot 4A in FIG. 20) on the vertical support rail 75A opposite the vertical support rail 75 which contains the latch assembly 14. The retainer assembly 18 is provided additional rigidity through the vertical support rail 75B attached to the other end of retainer catch 4. The additional vertical support beam 75B is secured between two horizontal supports parallel to the vertical support rail 75A and positioned near the end of the retainer catch 4.

The retainer catch 4 is made up of two bent plates, called retainer catch plate 160 and 161 that create a gap between them facing the interior of the building 10 when riveted together. The track 162 between the retainer catch plate 160 and 161 create an angled track on which the retainer roller 151 and 151A of the retainer assembly 18 are guided. The retainer catch 4 is positioned vertically so that the horizontal plane that lies at the center of the track 162 is parallel to the axis of the retainer bolt 155 in the retainer assembly 18.

The retainer roller 151 and 151A of the retainer assembly 18 are positioned farther into the door than the leading edge of the track 162 created by the retainer catch 4. As the sliding door 12 moves toward the closed position, the inside surface of the retainer catch track 162 comes in contact with retainer roller 151 and 151A of the retainer assembly 18. The retainer catch 4 is angled opposite of the retainer ramp 2 so that as the sliding door 12 moves toward being fully closed the door is drawn in toward the door jam 150 (see FIG. 19).

In the fully closed position the retainer catch 4 and retainer assembly 18 prevent the door from moving away from building 10 due to wind or other forces. The retainer catch 4 holds the sliding door 12 close to the door jam 150 to secure the sliding door 12 from moving away from building 10. To remove the sliding door 12 from the retainer catch 4, the door operator simply needs to unlatch or move the sliding door 12 along the track toward the open position. Once the sliding door 12 has moved the retainer catch 4 past the retainer roller 151 and 151A of the retainer assembly 18, the retainer catch 4 will no longer function to retain the door from moving away from the building.

Figure 21A:
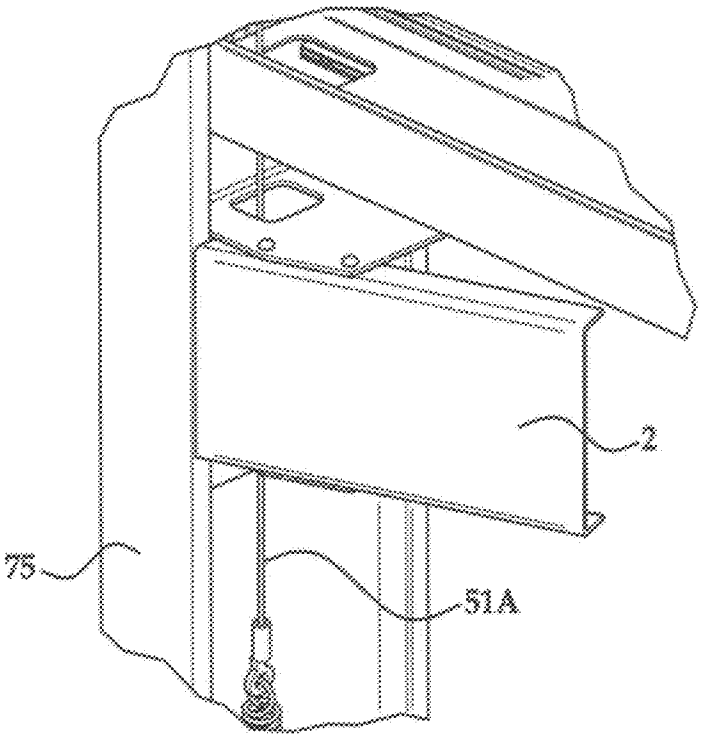
FIG. 21A is a magnified view of the retainer ramp.
Figure 21:
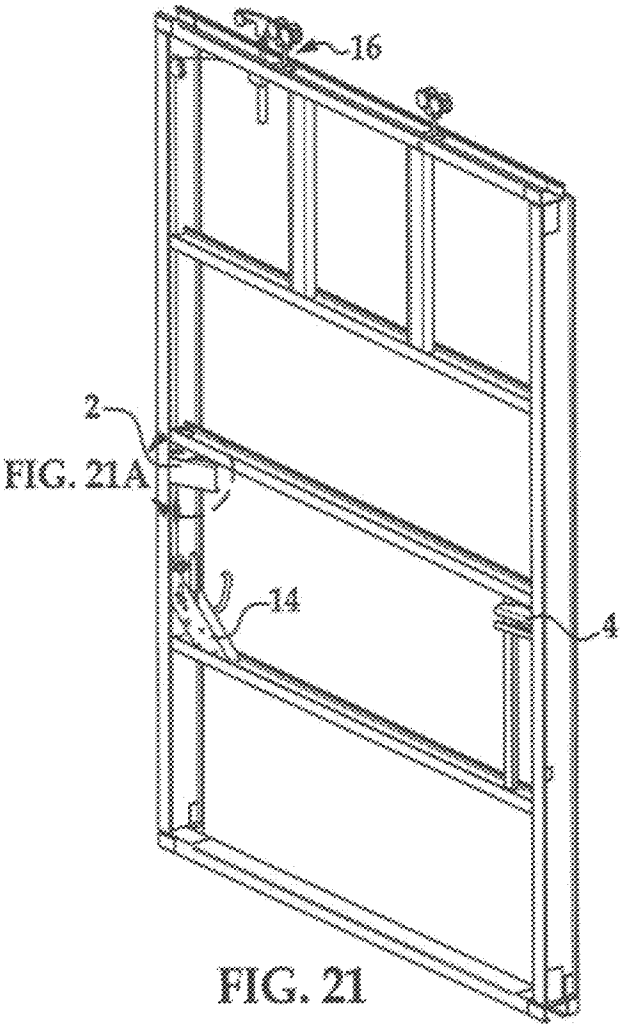
FIG. 21 is an interior view of the door including the retainer ramp.

Referring now to FIG. 21, the retainer ramp 2 is designed to push the retainer bolt 155 back, such that it will spring forward once the leading edge of the door has passed. The purpose of this is not to prevent sliding door 12 from being pulled away from the building, but rather to prevent sliding door 12 from sliding back along the track. Therefore, the retainer bolt 155 impedes the door path back along the track. The retainer ramp 2 is positioned inside the door in the web of horizontal and vertical members. It is illustrated as mounted against the vertical support rail 75 that contains the latching system. The retainer ramp 2 is positioned at a height at which the horizontal plane at the center of the ramp plate lies parallel to the axis of the retainer bolt 155. The retainer ramp 2 is positioned so that the end of the ramp incline is flush with the interior surface at the edge of the sliding door 12 and the retainer ramp 2 decline leads to the interior of the door. The retainer ramp 2, which is flush to the interior edge of sliding door 12 on one side, is angled in the direction of the exterior of the sliding door 12 on the other side. In this embodiment, the far end of retainer ramp 2 lies farther into the sliding door 2 than the retainer bolt 55 that extends into the door.

The retainer roller 151 and 151A catch the retainer ramp 2 as the door closes. The retainer ramp 2 connected to the sliding door 12 contacts the retainer roller 151 and 151A at the end of the retainer assembly 18. As sliding door 12 moves toward the fully open position the retainer ramp 2 pushes in the spring loaded bolt 155. Once the retainer ramp 2 and the inside edge of the vertical support rail 75 have passed the retainer roller 151 and 151A, there is no longer any force to hold the retainer bolt 155 back and so it will spring forward returning to the starting position. At this point sliding door 12 is retained in the open position as the extended retainer 155 bolt impedes the sliding door 12 from traveling along the track.

In the fully closed position retainer assembly 18 prevents the door from moving away from building 10 due to wind or other forces. In the fully open position retainer assembly 18 prevents the door from moving toward the closed position along the track. To release the sliding door 12 from the fully open position the door operator must physically push the retainer pin 156 of the retainer assembly 18 in toward the interior of the building, using it like a handle. Once the operator has pushed the retainer pin 156 far enough back so that the rollers no longer impede the closing of the sliding door 12, the operator can then pull the sliding door 12 into the closed position. Once the edge of the sliding door 12 has moved sufficiently far enough to the closed position that retainer roller 151 and 151A do not spring back to impede the travel of the sliding door 12, the operator can release the retainer pin 156 and allow the spring loaded retainer bolt 155 to return to the starting position. At this point the sliding door 12 is free to move along the overhead track 200.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. Indeed, many modifications and variations of the embodiments of the invention are possible in light of the above teachings, and the invention may be practiced otherwise than as specifically described yet remain within the scope of the appended claims and equivalents thereof.

While exemplary methods, systems, devices and applications thereof of the present disclosure, have been described herein, it should also be understood that the foregoing is only illustrative of exemplary embodiments, as well as principles of the invention, and that various modifications can be made by those skilled in the art without departing from the scope and spirit of the invention. Various modifications to these embodiments will be readily apparent to those skilled in the relevant art, and principles defined herein may be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

What is claimed is:

1. A latch assembly comprising:

a) a support member mounted in a movable body, wherein the movable body is slideably mounted on a track of a structural frame for movement in an interior space defined by the structural frame into and between a substantially open position and a substantially closed position;

b) a latch pivot arm pivotally mounted to the support member and configured to be biased toward a starting position;

c) a latch hook extending outwardly from the latch pivot arm, the latch hook including:

i) an intermediate section extending through an aperture in the movable body to a position adjacent to the periphery of the movable body, the intermediate section including a clearance slot extending through the intermediate section along a centerline axis; and ii) a distal end extending outwardly from the intermediate section and adjacent to the periphery of the movable body, the distal end including a front surface having an outer edge extending in a substantially transverse direction with respect to the centerline axis of the clearance slot, the front surface having a sloped outer surface;

d) an interlocking member extending in an opposing direction with respect to the latch hook, the latch hook adapted to engage the interlocking member with the movable body in the closed position, wherein movement of the movable body into the closed position causes the interlocking member to contact the sloped outer surface of the latch hook, the latch pivot arm being responsive to the contact between the sloped outer surface and the interlocking member by pivoting from the starting position and returning to the starting position upon the interlocking member being received within the clearance slot; and e) a retaining subsystem including:

a retainer assembly coupled to the structural frame, the retainer assembly including a retainer housing, a retainer bolt extending outwardly from the retainer housing towards the movable body, and a retainer roller rotatably coupled to a first end of the retainer bolt, a compression spring positioned within the housing to bias the retainer bolt outwardly from the housing, and a nut coupled to an opposite second end of the retainer bolt to limit movement of the retainer bolt towards the movable body;

a retainer catch coupled to a first side of the movable body, the retainer catch including a catch plate that defines a gap configured to receive the retainer assembly therein, the retainer roller positioned with respect to the retainer catch such that the retainer roller contacts an inner surface of the catch plate to bias the movable body towards the structural frame as the movable body is moved to the closed position; and a retainer ramp that is coupled to an opposite second side of the sliding door, the retainer ramp including an inclined surface configured to contact the retainer roller to bias the retainer bolt inwardly towards the retainer housing as the sliding door is moved to the open position.

2. A latch assembly as recited in claim 1, wherein the movable body is a sliding door.

3. A latch assembly as recited in claim 1, wherein the front surface has a triangular cross-sectional profile.

4. A latch assembly as recited in claim 1, wherein the front surface includes an upper outer surface and a lower outer surface, wherein the upper and lower surfaces are sloped at substantially similar opposing slopes.

5. A latch assembly as recited in claim 1, wherein the latch pivot arm is operatively associated with at least one handle extending adjacent to the exterior of the movable body, wherein the latch pivot arm pivots from the starting position in response to movement of the handle.

6. A latch assembly as recited in claim 1, further comprising a locking member configured for being set in an activated condition and a deactivated condition from the exterior of the movable body, wherein the locking member blocks pivotal movement of the latch pivot arm upon being set in the activated condition and allows pivotal movement of the latch pivot arm upon being set in the deactivated condition.

7. A latch assembly as recited in claim 1, wherein the interlocking member further comprises a sloped outer surface at a substantially similar opposing slope with respect to the sloped outer surface of the front surface.

8. A latch assembly as recited in claim 1, wherein the interlocking member is part of a substantially similar opposing latch pivot arm.

9. A latch assembly in claim 8, wherein the opposing latch pivot arm is operatively associated with a support member mounted in a substantially similar opposing movable body mounted for movement in the interior space.

10. A latch assembly comprising:

a) a support member mounted in a sliding door body, wherein the sliding door body is mounted on a track of a door frame for movement in an interior space defined by the door frame, into and between a substantially open position and a substantially closed position;

b) a latch pivot arm pivotally mounted to the support member and configured to be biased toward a starting position;

c) a latch hook extending outwardly from the latch pivot arm, the latch hook including:

i) an intermediate section extending through an aperture in the door body to a position adjacent to the periphery of the sliding door body, the intermediate section including a clearance slot extending through the intermediate section along a centerline axis;

ii) a distal end extending outwardly from the intermediate section and adjacent to the periphery of the door body, the distal end including a front surface having an outer edge extending in a substantially transverse direction with respect to the centerline axis of the clearance slot, the front surface having a sloped outer surface;

d) an interlocking member extending in an opposing direction with respect to the latch hook, the latch hook adapted to engage the interlocking member with the sliding door body in the closed position, wherein movement of the sliding door body into the closed position causes the interlocking member to contact the sloped outer surface of the latch hook, the latch pivot arm being responsive to the contact between the sloped outer surface and the interlocking member by pivoting from the starting position and returning to the starting position upon the interlocking member being received within the clearance slot;

e) at least one handle extending adjacent to the exterior of the sliding door body operatively associated with the latch pivot arm, wherein the latch pivot arm pivots from the starting position in response to pivotal movement of the handle; and f) a track latching mechanism including:

a lift rod assembly coupled to the latch pivot arm;

a track wheel assembly coupled to the sliding door body for supporting the sliding door body from the track; and a latch mechanism plate pivotably coupled to the track wheel assembly and movable between a latched position and an unlatched position, wherein the track includes a stop member, the latch mechanism plate adapted to engage the stop member in the latched position to prevent a movement of the sliding door body along the track, and wherein a movement of the latch pivot arm causes the lift rod assembly to contact the latch mechanism plate to move the latch mechanism plate between the latched position and the unlatched position;

g) a retainer subsystem;

the retainer subsystem including a retainer assembly coupled to the door frame; and a retainer catch coupled to the sliding door body, the retainer catch including a gap configured to receive the retainer assembly therein to bias the sliding door body towards the structural frame with the sliding door body in the closed position.

11. A latch assembly in claim 10, further comprising a locking member configured for being set in an activated condition and a deactivated condition from the exterior of the sliding door body, wherein the locking member blocks pivotal movement of the latch pivot arm upon being set in the activated condition and allows pivotal movement of the latch pivot arm upon being set in the deactivated condition.

12. A latch assembly as recited in claim 10, wherein the interlocking member is part of a substantially similar opposing latch pivot arm.

13. A latch assembly as recited in claim 12, wherein the opposing latch pivot arm is operatively associated with a support member mounted in a substantially similar opposing sliding door mounted for movement in the interior space.

14. A latch assembly as recited in claim 12, wherein the opposing latch pivot arm is operatively associated with a support member mounted in the door frame.

15. A latch assembly as recited in claim 10, wherein the interlocking member is connected with the door frame.

16. A locking system for use with a sliding door, the sliding door slideably mounted to a track coupled to a structural frame, the sliding door movable between an open position providing access into an interior of the structural frame and a closed position preventing access into the interior, the locking system comprising:

a latch assembly including:

a support member coupled an interior surface of the sliding door;

a latch pivot arm pivotably coupled to the support member, the latch pivot arm movable between a locked position and an unlocked position;

a latch hook extending outwardly from the latch pivot arm, the latch hook orientated to engage an opposing interlocking member with the latch pivot arm in the locked position, the latch hook including:

an intermediate section extending through an aperture defined through an outer surface of the sliding door, the intermediate section including a clearance slot extending through the intermediate section along a centerline axis; and a distal end extending outwardly from the intermediate section and positioned adjacent to the door outer surface, the distal end including a front surface having a sloped outer surface and an outer edge extending in a substantially transverse direction with respect to the clearance slot centerline axis;

a track latching mechanism including:

a lift rod assembly coupled to the latch pivot arm;

a track wheel assembly coupled to the sliding door for supporting the sliding door from the track; and a latch mechanism plate pivotably coupled to the track wheel assembly and movable between a latched position and an unlatched position, wherein the track includes a stop member, the latch mechanism plate adapted to engage the stop member in the latched position to prevent a movement of the sliding door along the track, and wherein a movement of the latch pivot arm from the locked position towards the unlocked position causes the lift rod assembly to contact the latch mechanism plate to move the latch mechanism plate from the latched position to the unlatched position; and a retaining subsystem including:

a retainer assembly coupled to the structural frame, the retainer assembly including a retainer housing, a retainer bolt extending outwardly from the retainer housing towards the movable body, and a retainer roller rotatably coupled to a first end of the retainer bolt, a compression spring positioned within the housing to bias the retainer bolt outwardly from the housing, and a nut coupled to an opposite second end of the retainer bolt to limit movement of the retainer bolt towards the movable body;

a retainer catch coupled to a first side of the sliding door, the retainer catch including a catch plate that defines a gap configured to receive the retainer assembly therein, the retainer roller positions with respect to the retainer catch such that the retainer roller contacts an inner surface of the catch plate to bias the sliding door towards the structural frame as the sliding door is moved to the closed position; and a retainer ramp that is coupled to an opposite second side of the sliding door, the retainer ramp including an inclined surface configured to contact the retainer roller to bias the retainer bolt inwardly towards the retainer housing as the sliding door is moved to the open position.

17. A locking system as recited in claim 16, wherein the latch assembly further comprises a locking member coupled to the support member for selectively preventing a movement of the latch pivot arm, the locking member configured for being set in an activated condition and a deactivated condition, wherein the locking member blocks pivotal movement of the latch pivot arm upon being set in the activated condition and allows pivotal movement of the latch pivot arm upon being set in the deactivated condition.

18. A locking system as recited in claim 16, wherein the latch assembly includes a handle coupled to the latch pivot arm, the handle configured to enable a user to operate the latch pivot arm to move the tracked latching mechanism to the unlatched position to allow the user to move the sliding door from the closed positioned towards the open position.

* * * * *